US007278418B2

(12) United States Patent
Duphily et al.

(10) Patent No.: US 7,278,418 B2
(45) Date of Patent: Oct. 9, 2007

(54) RADIANT HEAT DEFLECTOR ASSEMBLY

(76) Inventors: Caroline Duphily, 176-6 Place de Chambord, Ste-Julie, Quebec (CA) J3E 2P6; Luc Briere, 825 des Sapins, St-Eustache, Quebec (CA) J7R 6K7; Pat Caruso, c/o 428 Millen Road, Unit 23, Stoney Creek, ON (CA) L8E 3N9

( * ) Notice: Subject to any disclaimer, the term of this patent is extended or adjusted under 35 U.S.C. 154(b) by 353 days.

(21) Appl. No.: 10/841,443

(22) Filed: May 10, 2004

(65) Prior Publication Data

US 2004/0226551 A1 Nov. 18, 2004

(51) Int. Cl.
*F24C 15/22* (2006.01)
*F24C 15/24* (2006.01)

(52) U.S. Cl. ..... 126/92 B; 126/92 AC

(58) Field of Classification Search ..... 126/92 B, 126/92 AC, 91 R, 92 R; 431/350, 354, 343, 431/344; 119/305, 307
See application file for complete search history.

(56) References Cited

U.S. PATENT DOCUMENTS

| | | | | |
|---|---|---|---|---|
| 2,130,086 | A * | 9/1938 | Hart | 126/85 R |
| 2,985,137 | A * | 5/1961 | Horne | 126/92 B |
| 3,349,752 | A * | 10/1967 | Murphy | 119/307 |
| 4,063,876 | A * | 12/1977 | Schweiss | 431/344 |
| 4,823,838 | A | 4/1989 | Ferlin | |
| 5,094,259 | A | 3/1992 | Hsu | |
| 5,181,846 | A | 1/1993 | Chang | |
| 5,964,214 | A * | 10/1999 | Ferlin et al. | 126/92 B |
| 5,964,233 | A | 10/1999 | Clark et al. | |
| 6,041,768 | A | 3/2000 | Giammona | |
| 6,164,273 | A * | 12/2000 | Waters | 126/92 B |
| 6,336,450 | B1 | 1/2002 | Collet | |
| 6,381,407 | B2 | 4/2002 | Choi | |
| 6,397,835 | B1 | 6/2002 | Liang | |

FOREIGN PATENT DOCUMENTS

| | | | |
|---|---|---|---|
| CA | 2349132 | A1 * | 11/2001 |
| DE | 2 023 734 | A * | 11/1970 |
| DE | 202 10 962 | U1 | 10/2002 |
| EP | 0 976 979 | A1 | 2/2000 |
| GB | 432182 | | 6/1934 |
| NR | 139119 | | 6/1930 |
| NR | 820 732 | | 11/1951 |
| WO | WO 02/24019 | A1 | 3/2002 |

* cited by examiner

*Primary Examiner*—Josiah C. Cocks

(57) ABSTRACT

The present invention is a radiant heat deflector assembly for radiating heat on a surface, wherein the assembly includes; a radiant heat source radiating direct emissions, and at least one radiant heat deflector spaced from the heat source. The heat source is so positioned and configured to include radiating direct emissions onto the deflector, the deflector being so positioned, configured and sized as to reflect radiant emissions onto a surface thereby heating the surface. Preferably the heat source adapted to radiate useful direct emissions upwardly towards the deflector and downwardly toward the surface or onto a second deflector such that both direct emissions and reflected emissions heat the surface. Preferably the heat source including an emitter for producing direct radiant emissions and the emitter producing useful direct emissions from both a top surface and a bottom surface of the emitter such that both direct emissions and reflected emissions reach the surface.

23 Claims, 29 Drawing Sheets

PRIOR ART

999

199

198

FIG. 27
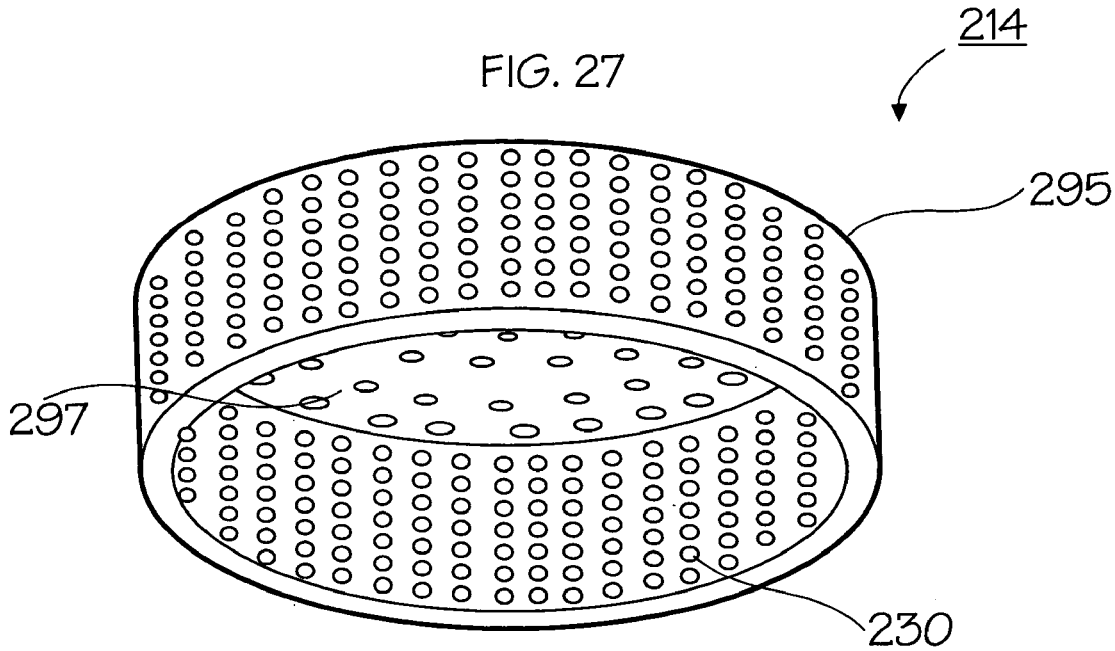
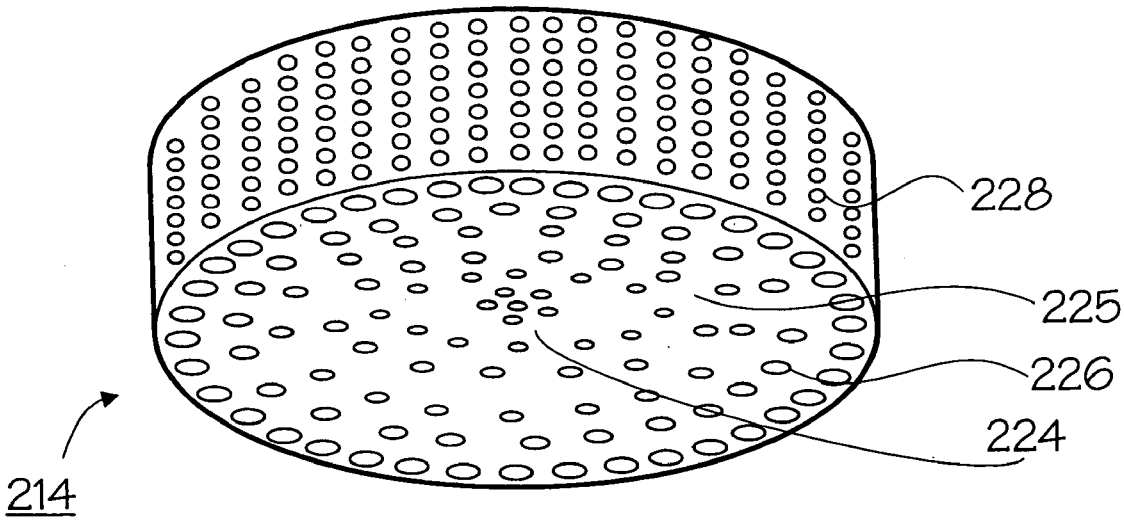
FIG. 28

FIG. 29
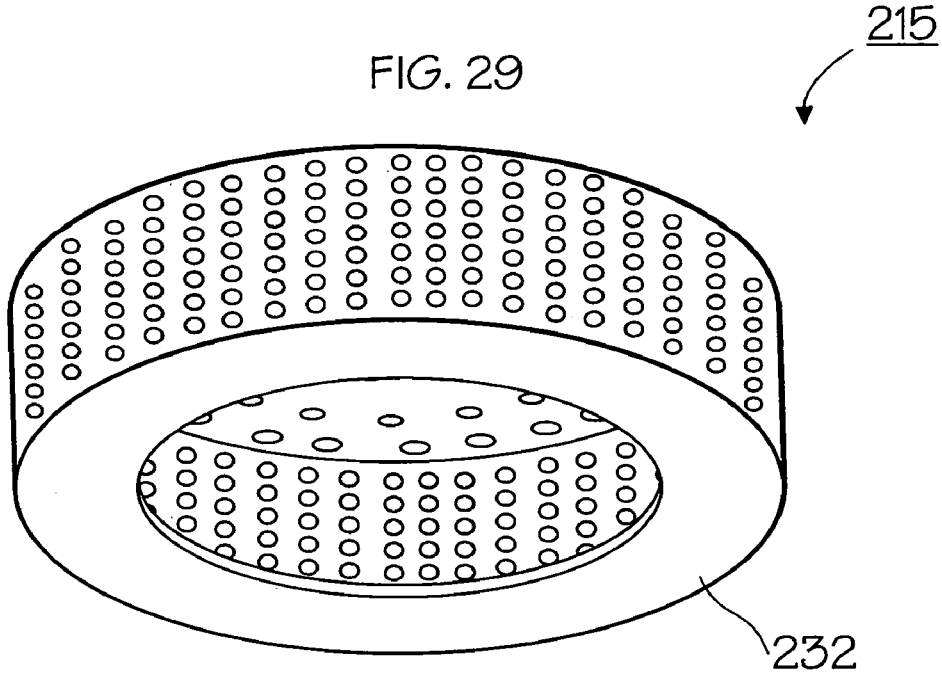
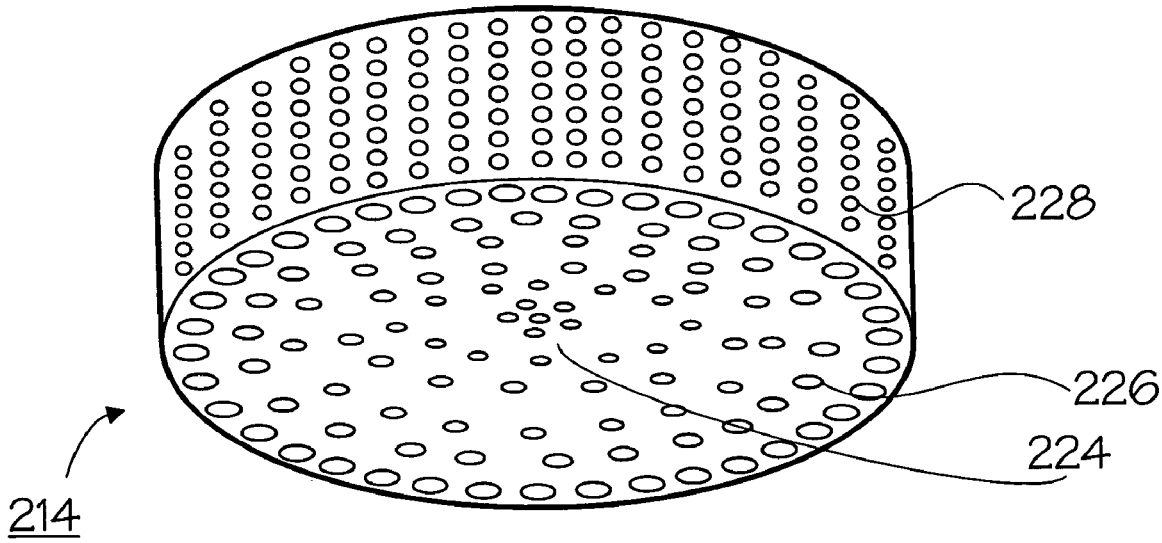
FIG. 30

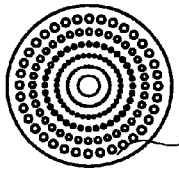
FIG. 34
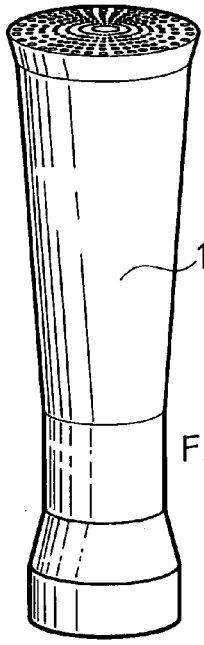
FIG. 37
FIG. 39
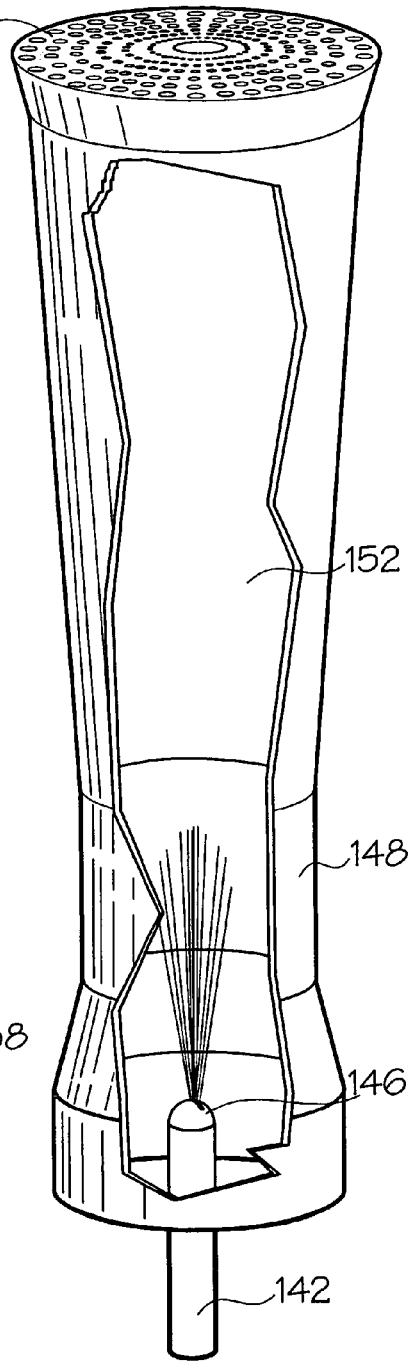
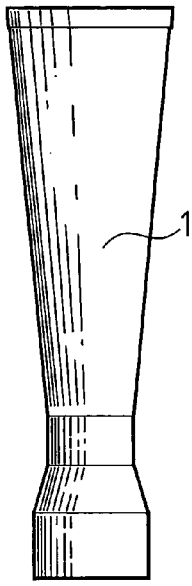
FIG. 35
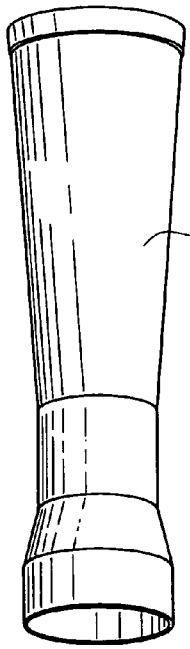
FIG. 38
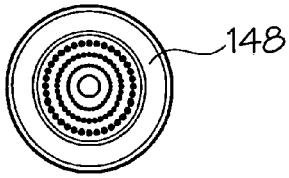
FIG. 36

RADIANT HEAT DEFLECTOR ASSEMBLY

FIELD OF THE INVENTION

The present invention relates to heaters. More specifically, the present invention is concerned with a radiant heat deflector assembly.

BACKGROUND OF THE INVENTION

Radiant heaters are well known and used to provide heat to selected areas of a given space. These heaters may be used to heat spaces such as workshops, patios, terraces, and the like or for industrial purposes such as drying or treating materials to give only two examples.

Conventional radiant heaters include a radiant heat source and mounting elements in order to mount and position the heat source in a variety of ways so as to heat a particular object, surface area or other targets.

A drawback of the prior art radiant heaters is that the heat is not uniform throughout the target surface. Heating is not uniform as one moves away from the heat source. This creates hot points or surfaces which may be overheated and hence, uncomfortable to people on a patio or damaging to material. Furthermore, the heater is somewhat useless at the areas away from the heating device since the temperature is not sufficient for comfort or industrial utility depending on the use of that particular heater.

FIGS. 1 and 2 described hereinafter exemplify the above stated drawback. FIG. 1 is a graph showing a 3D heating profile and FIG. 11 is a 2D heating profile of a prior art mushroom-type heater depicted in FIGS. 8 through 10. FIG. 2 is a graph showing a 3D heating profile of a flat radiant heater. As can be ascertained from the foregoing graphs, heat is not uniformly distributed throughout a given surface area by these prior art heaters.

Attempts to address this drawback have been the use of more radiant heaters for the same surface area or the use of wider or longer radiant heat sources. Both attempts incurring greater costs.

Thus there remains a need to provide a heater that can radiate heat in a more uniform way throughout a target surface area.

OBJECTS OF THE INVENTION

The object of the present invention is therefore to provide an improved radiant type heater.

SUMMARY OF THE INVENTION

The term "surface" should be construed herein to include the surface of any target area, animate or inanimate object of any kind that is to be heated as is known in the art.

An advantage of the present invention is that the target surface is more uniformly heated.

Another advantage of the present invention is that a relatively greater surface area may be uniformly heated.

A further advantage of the present invention is that it minimizes equipment costs and takes relatively less space making the present invention relatively inexpensive in terms of equipment and operation.

Other objects, advantages and features of the present invention will become more apparent upon reading of the following non restrictive description of embodiments thereof, given by way of example only with reference to the accompanying drawings.

More specifically, in accordance with the present invention, there is provided a radiant heater deflector assembly for radiating heat on a surface, said assembly comprising: heat source; and a radiant heat deflector being spaced from the surface; wherein the heat source is so positioned and configured as to radiate the heat on the deflector, the deflector being so positioned, configured and sized as to uniformly deflect the heat on the surface.

The present invention a radiant heat deflector assembly for radiating heat on a surface includes:

(a) a radiant heat source radiating direct emissions; and (b) and at least one radiant heat deflector spaced from the heat source;

(c) wherein said heat source is so positioned and configured to include radiating direct emissions onto said deflector, said deflector being so positioned, configured and sized as to reflect radiant emissions onto a surface thereby heating the surface.

Preferably wherein said heat source adapted to radiate useful direct emissions upwardly towards said deflector and downwardly toward the surface or onto a second deflector such that both direct emissions and reflected emissions heat said surface.

Preferably, wherein said heat source including an emitter for producing direct radiant emissions.

Preferably wherein said emitter producing useful direct emissions from both a top surface and a bottom surface of the emitter such that both direct emissions and reflected emissions reach the surface.

Preferably, wherein said emitter adapted to radiate direct emissions upwardly towards said deflector and downwardly toward the surface.

Preferably, wherein said emitter adapted to radiate direct emissions upwardly towards said deflector and downwardly onto a second deflector.

Preferably including at least two radiant heat deflectors such that reflected emissions can be directed by said deflectors in optimal fashion to the surface.

Preferably wherein one of said deflectors being mounted above said emitter and one of said deflectors being mounted below said emitter for reflecting emissions to said surface.

Preferably wherein said emitter including a number of perforations wherein said perforations are distributed to optimize the temperature uniformity of the emitter.

Preferably wherein the number and density of perforations is increased in the naturally coldest area of the emitter and the number and density of perforations is minimized in the naturally hottest areas of the emitter.

Preferably wherein said emitter shape and said deflector shape is selected to direct and redirect substantially all useful radiant emissions from said emitter to said surface.

The present invention also including a method of radiating heat on a surface including:

a) radiating heat from an emitter;

b) deflecting said heat onto a surface with at least one deflector;

c) wherein said emitter radiating heat primarily upwardly towards a deflector and downwardly towards said surface.

Preferably wherein said emitter producing useful direct emissions from both a top and bottom surface such that both direct and reflected emissions reach the surface.

Preferably wherein said heat source including an emitter and a burner producing a flame for heating said emitter, said burner including a gas nozzle disposed within a venturi, wherein said venturi for drawing in primary combustion air and gas.

Preferably wherein said venturi further including a mixing chamber for thoroughly mixing the primary combustion air and the gas.

Preferably wherein the primary combustion air making up at least 70% of the total amount of combustion air required for complete combustion of the gas.

Preferably wherein the venturi being cylindrical in shape and shrouded by an externally disposed cylindrically shaped air inlet cover.

Preferably wherein said venturi further including a flame retainer proximate the upper end of said venturi.

Preferably wherein said burner further including a flame jacket for funnelling the flame from said burner and protecting said-flame from ambient winds.

BRIEF DESCRIPTION OF THE DRAWINGS

In the appended drawings where like elements are referenced by like reference numerals throughout and in which:

FIG. 12(*a*) is an optimal two dimensional graph showing heat distribution of a radiant heater reflecting heat onto a surface wherein the units are shown as distance in feet away from the centre of the radiant heater along the X axis and effective radiant flux on the Y axis, wherein a perfect theoretical heat distribution would be simply a constant heat reaching a surface 16 as shown in FIG. 3 regardless of the distance away from the heater.

FIG. 27 is a top perspective view of the emitter 214 as shown deployed in FIG. 17.

FIG. 28 is a bottom schematic perspective view of the emitter 214 as shown deployed in FIG. 17.

FIG. 29 is a bottom perspective view of an emitter 215 as shown in FIG. 41 including a bottom flange.

FIG. 30 is an inverted perspective view of the emitter 215 as shown in FIG. 29.

FIG. 34 is a top view of the venturi as shown in FIG. 44.

FIG. 35 is a side elevational view of the venturi as shown in FIG. 44.

FIG. 36 is a bottom plan view of the venturi as shown in FIG. 44.

FIG. 37 is a top perspective view of the venturi as shown in FIG. 44.

FIG. 38 is a bottom perspective view of the venturi as shown in FIG. 44.

FIG. 39 is a top perspective schematic partial cut away view of the venturi as shown in FIG. 44.

DEFINITIONS

Figure 1:
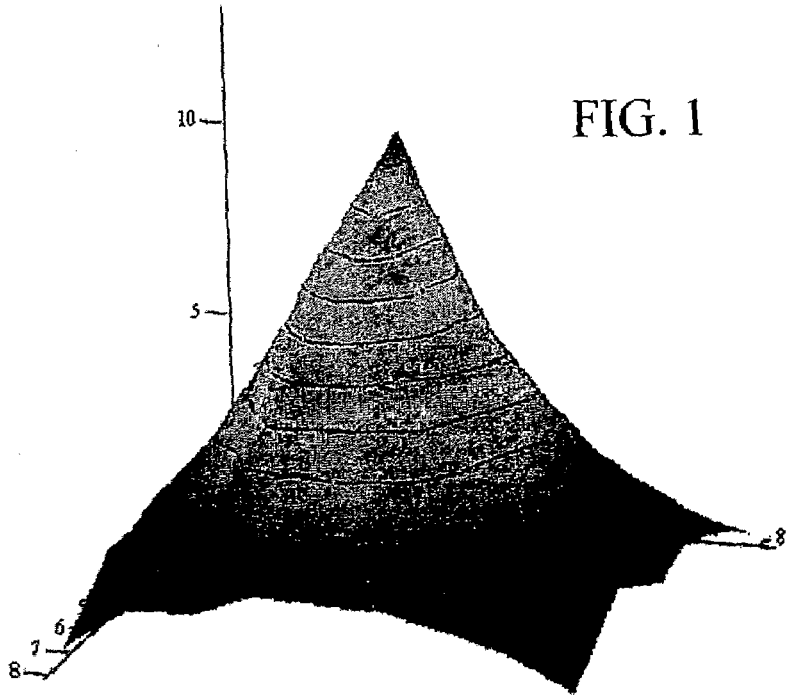
FIG. 1 PRIOR ART
FIG. 1 is a graph representing the heating profile of a "mushroom" type prior art heater.
Figure 2:
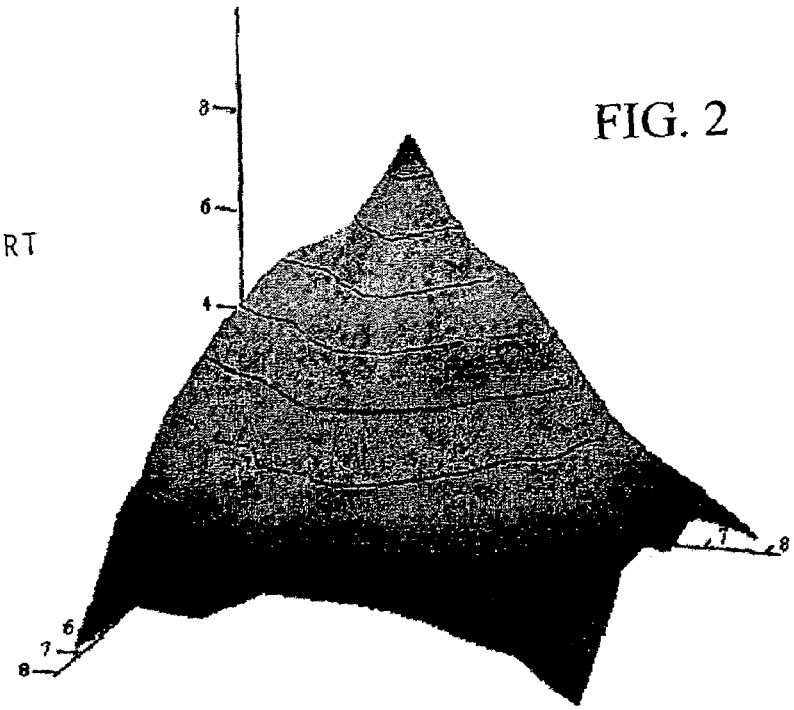
FIG. 2 is a graph representing the heating profile of a prior art flat radiant heater.

Useful emissions: Radiant emissions which can be directed, or redirected to heat a desired surface. Non useful emissions for example are those which impinge back onto the emitter itself such as interior emissions 972.

Radiant waves or Radiant emissions: Radiant waves or emissions is the term used to describe the radiant energy emitted from a radiant source. Radiant energy travels as radiant waves or emissions from the radiant emitting source. Radiant waves or emissions heat a body on which they impinge.

Effective Radiant Flux: Also known as ERF is radiant energy reaching an object or surface measured in BTU per ($hr*ft^2$) or its equivalent.

DETAILED DESCRIPTION OF THE PREFERRED EMBODIMENT

With reference to FIGS. 3 to 7, the present invention will be herein described by way of embodiments thereof which serve to exemplify the invention and not limit its scope.

FIGS. 3, 4, 5 and 6 respectively show radiant heat deflector assemblies 10, 20, 30 and 40.

Each radiant heat deflector assembly 10, 20, 30 and 40 includes a respective heating source 12 and a respective heat deflector 14.

The deflector 14 is spaced from the surface 16, which is to be heated. This surface can represent a patio or other surface. The skilled artisan will understand that it is within the scope of the present invention that the target surface, which is to be heated, can be the surface of any area or, animate or inanimate object including without limitation a person. The skilled artisan will also appreciate present invention may also have industrial application such as drying or treating materials among other applications.

The heat source 12 and the deflector 14 may be disposed in a variety of ways so as to radiate heat on the target surface, which will be described herein below.

Figure 3:
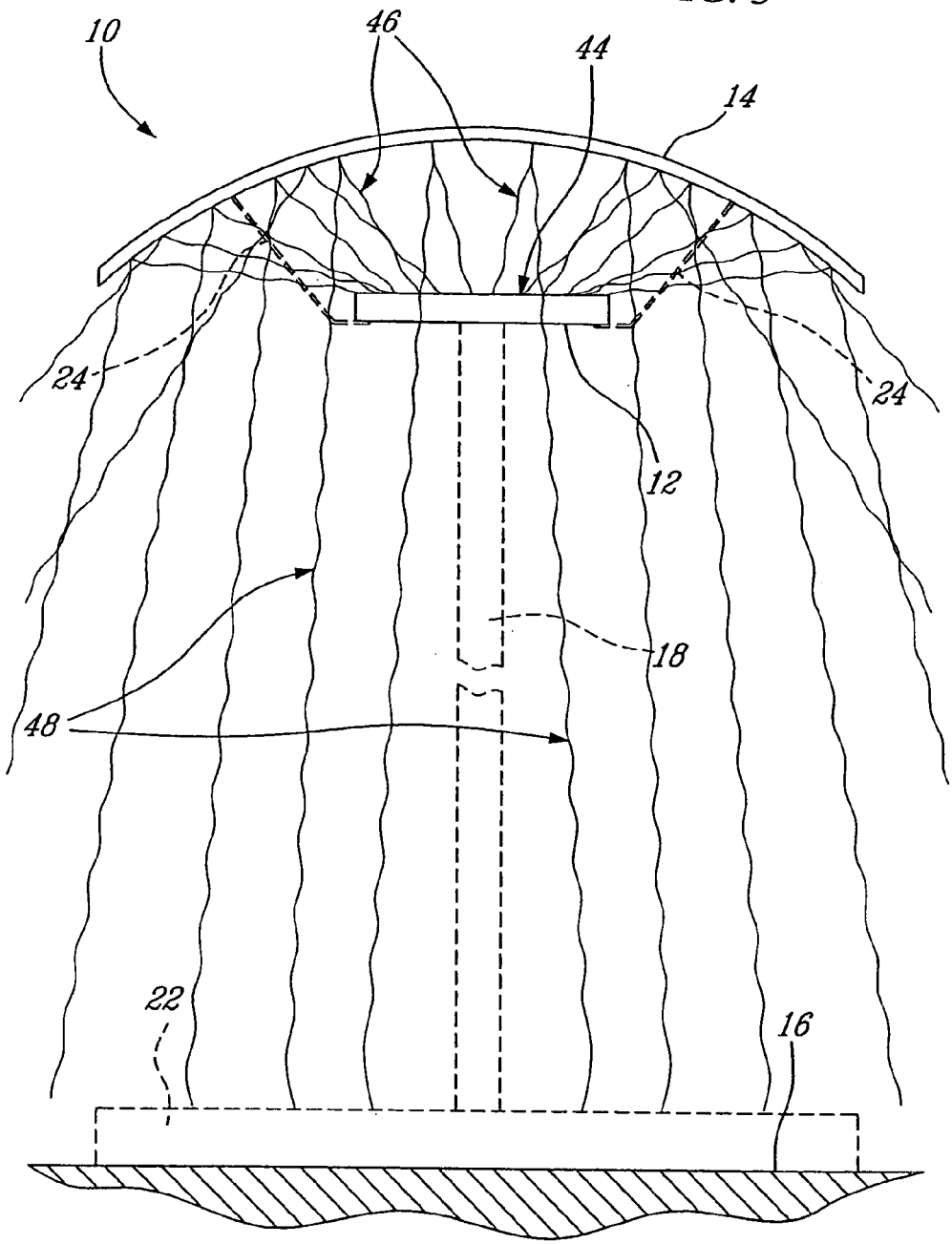
FIG. 3 is a schematic view of the radiant heater deflector assembly according to an embodiment of the present invention.

FIG. 3 shows the radiant heat deflector assembly 10 having a heat source 12 which is spaced from the surface 16 by way of a leg member 18 upstanding from a platform 22 on surface 16. The deflector 14 is carried by the heat source 12 by way of brackets 24. The heat source may be pivotally mounted to the leg member 18. The deflector 14 may be adjustably mounted to the bracket 24. The leg member 18 may be reciprocally extendable. In this way, the disposition of the heat source 12 and deflector 14 is adjustable.

Figure 4:
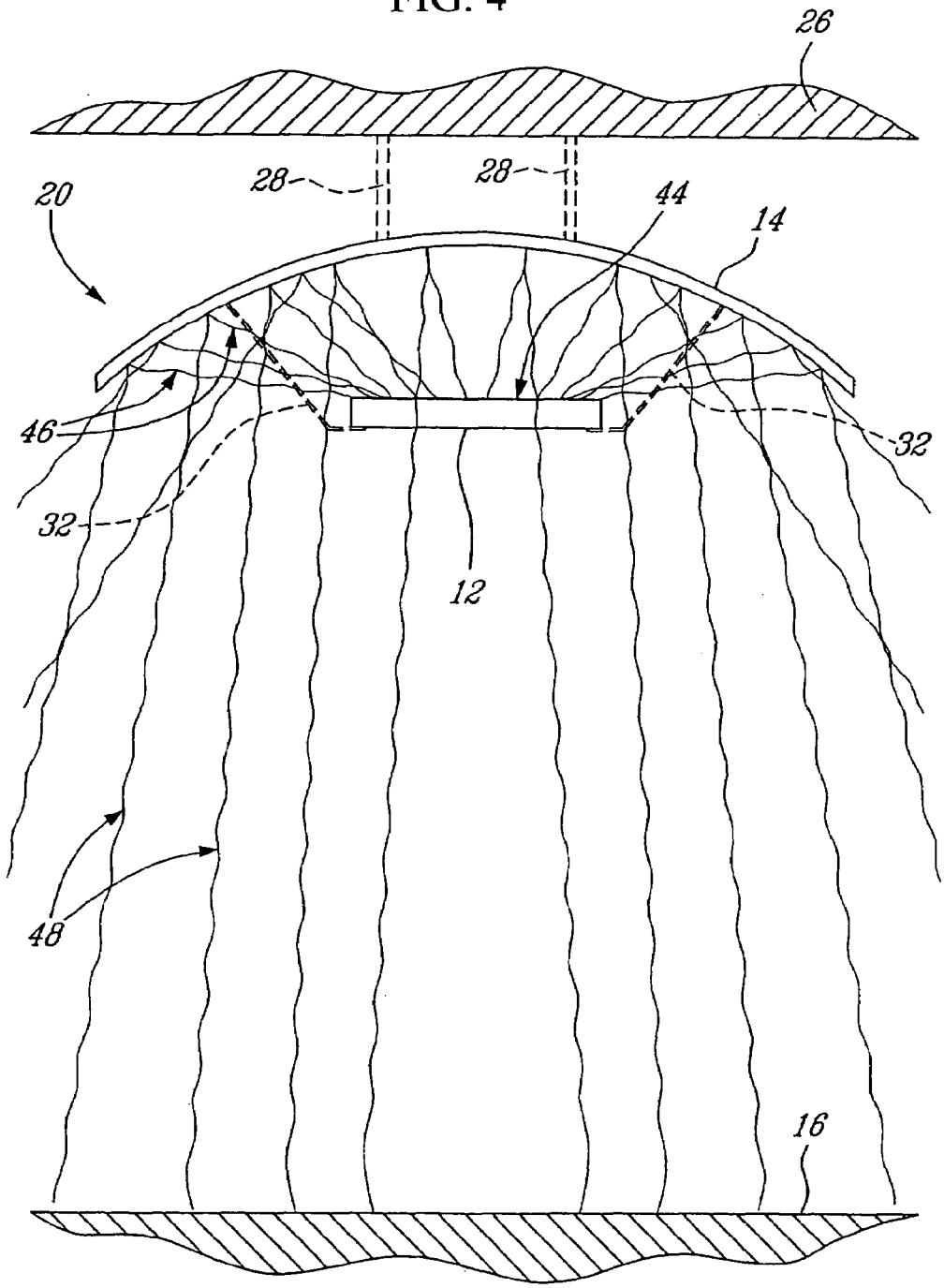
FIG. 4 is a schematic view of the radiant heater deflector assembly according to another embodiment of the present invention.

FIG. 4 shows the radiant heat deflector assembly 20 having a deflector 14 hanging from a ceiling 26 by way of arms 28 mounted to the ceiling 26 by conventional means as can be contemplated by the skilled artisan. The hanging deflector 14 carries the heat source 12 by way of brackets 32. The deflector may be adjustably mounted to arms 28. The arms 28 may be reciprocally adjustably mounted to arms 28. The arms 28 may be reciprocally extendable. The heat source may be adjustably mounted to the brackets 32.

Figure 5:
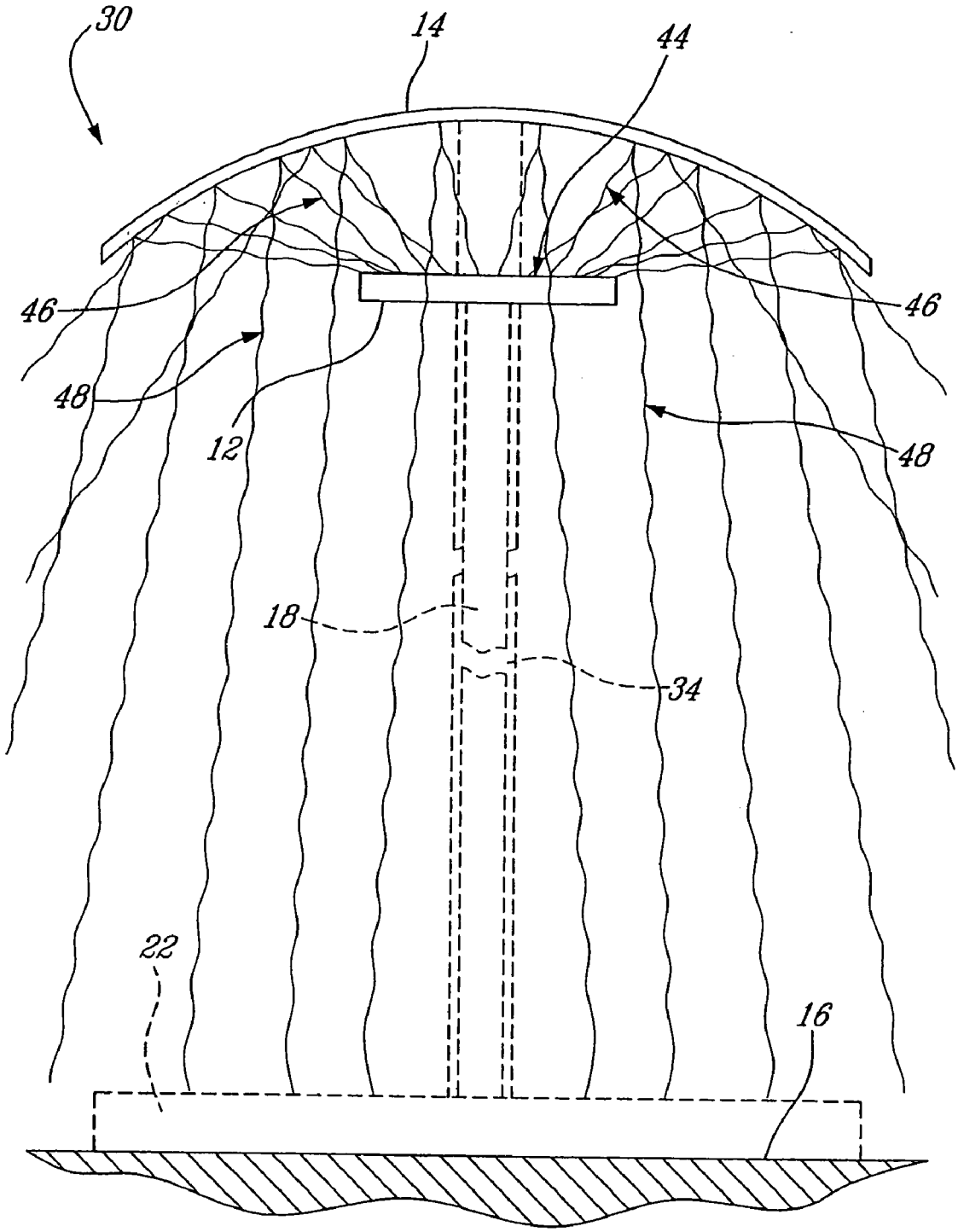
FIG. 5 is a schematic view of the radiant heat deflector assembly according to a further embodiment of the present invention.

FIG. 5 shows the radiant heat deflector assembly 30 having a heat source 12 which is spaced from the surface 16 by way of a leg member 18 upstanding from a platform 22. The deflector 14 is also upwardly spaced from the surface 16 above the heat source 12 by way of a leg member 34. The leg member 34 may also be reciprocally extendable and the deflector 14 may be pivotally mounted thereto.

Figure 6:
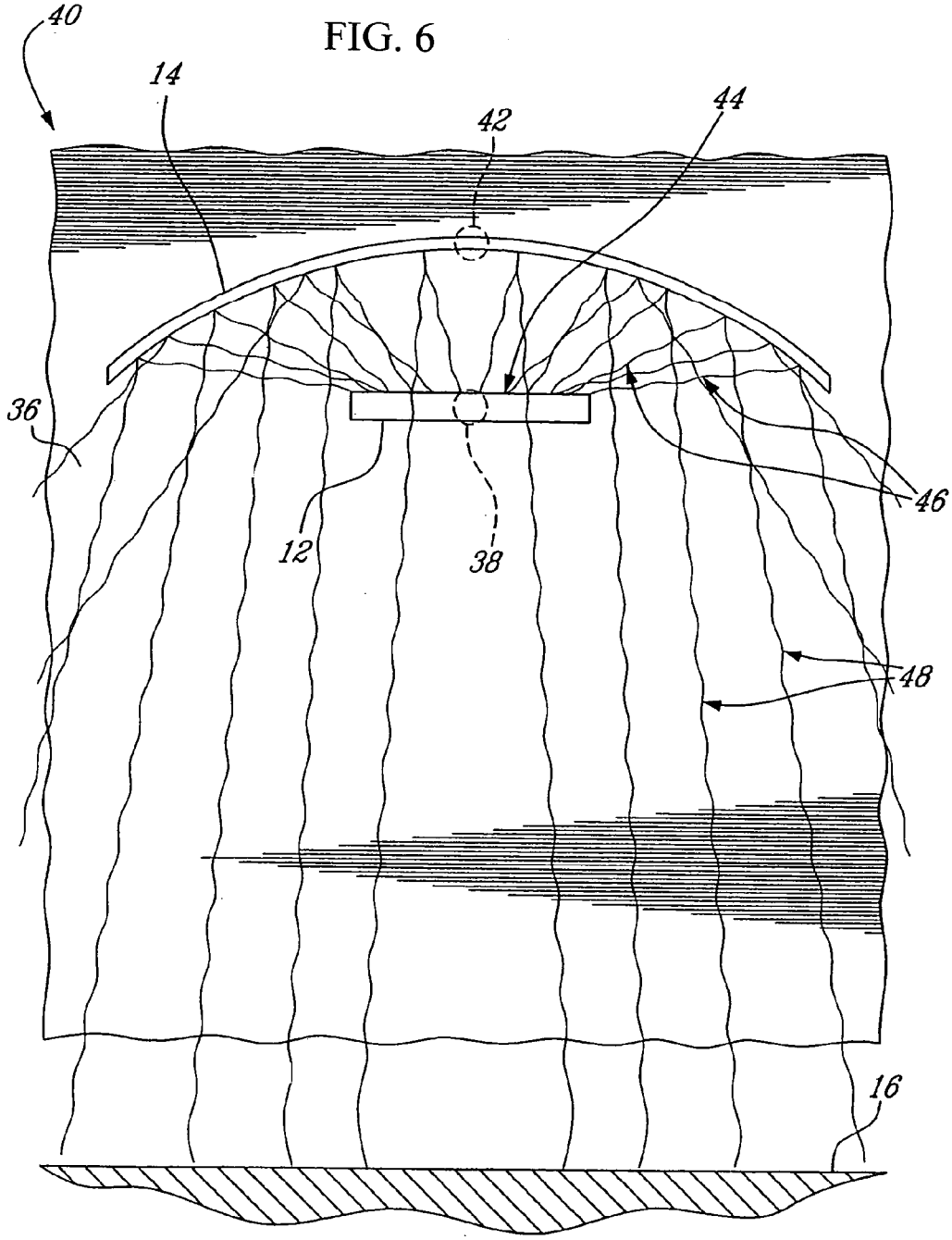
FIG. 6 is a schematic view of the radiant heat deflector assembly according to yet another embodiment of the present invention.

FIG. 6 shows the radiant heat deflector assembly 40 including a heat source 12 and a deflector 14 mounted to a wall structure 36 by way of respective wall-mounting members (not shown) mounted to their respective areas 38 and 42. The wall-mounted members may be extending horizontal arms or extendable telescoping or accordion members. Furthermore, assembly 40 may include a single extendable wall-mounting member branching off to be mounted to both the heat source 12 and the deflector 14 about their areas 38 and 42 respectively. It should also be noted that the various wall mounting elements may be mounted by universal joints about areas 38 and 42.

As can be ascertained, a variety of ways to dispose the radiant heat deflector assemblies 10, 20, 30 and 40 can be contemplated within the scope of the present invention. In each case, the disposition of the heat source and the deflector may be adjustable.

In the present invention, the heating source 12 is so positioned with respect to the deflector 14 as to radiate heat thereto, in concordance, the deflector 14 is so positioned with respect to the surface 16 as to deflect heat towards the surface 16 as will be better explained below.

With respect to FIG. 3 to 6, each heating source 12 includes a heat radiant side 44, which includes heating elements (not shown) as is known in the art. The heat radiating side 44 is opposite the surface 16 and faces the deflector 14. In this way, the heating source 12 radiates heat, as shown by waves 46, towards the deflector 14 and hence, the radiating heat is deflected, as shown by waves 48, by the deflector 14 towards the surface 16.

In the non-limiting example illustrated herein, the deflector 16 has a semi-circular or dome-like configuration. It should be noted that within the scope of the present invention, the deflector 14 is so positioned, configured and sized as to deflect radiant heat most uniformly over a given surface area 16.

Figure 7:
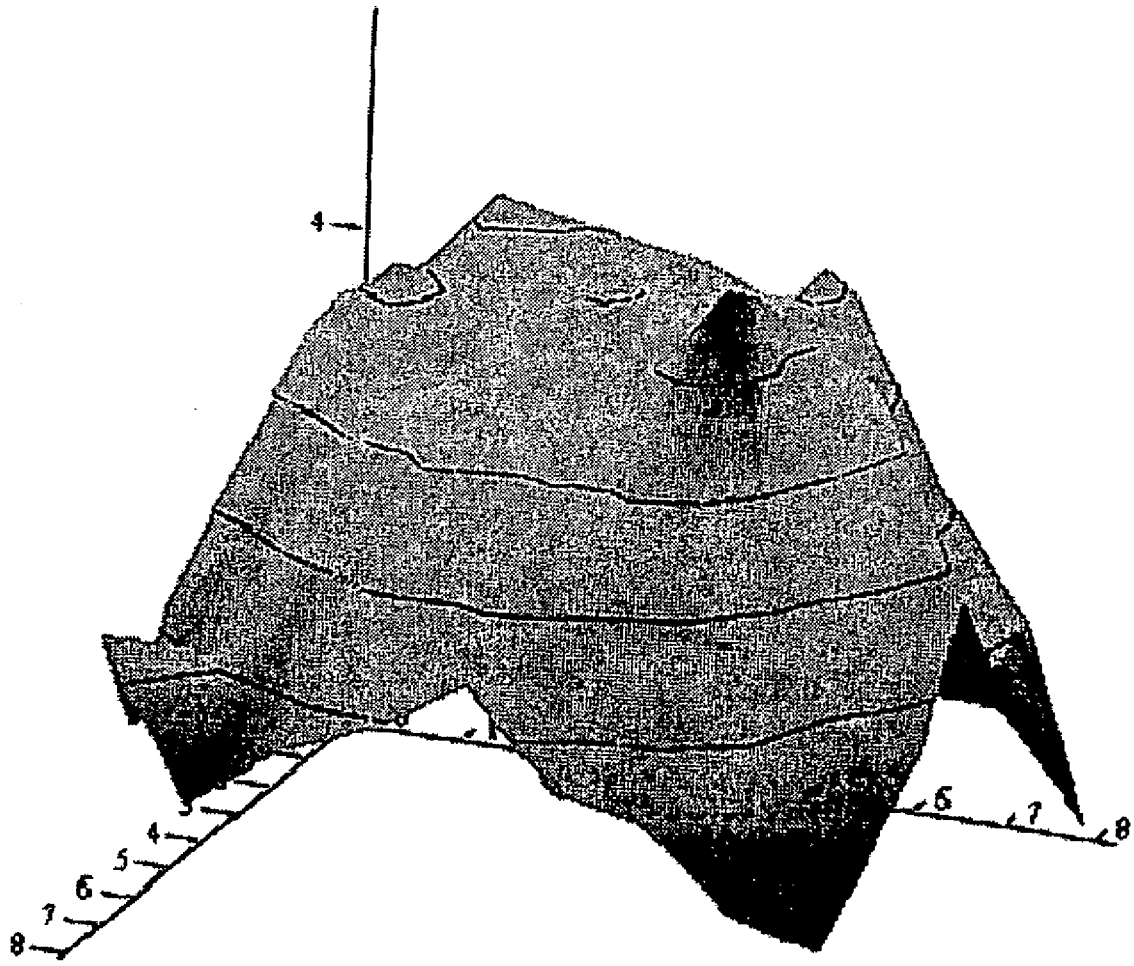
FIG. 7 is a graph showing the heat distribution of the radiant heat deflector assembly according to an embodiment of the present invention.
Figure 8:
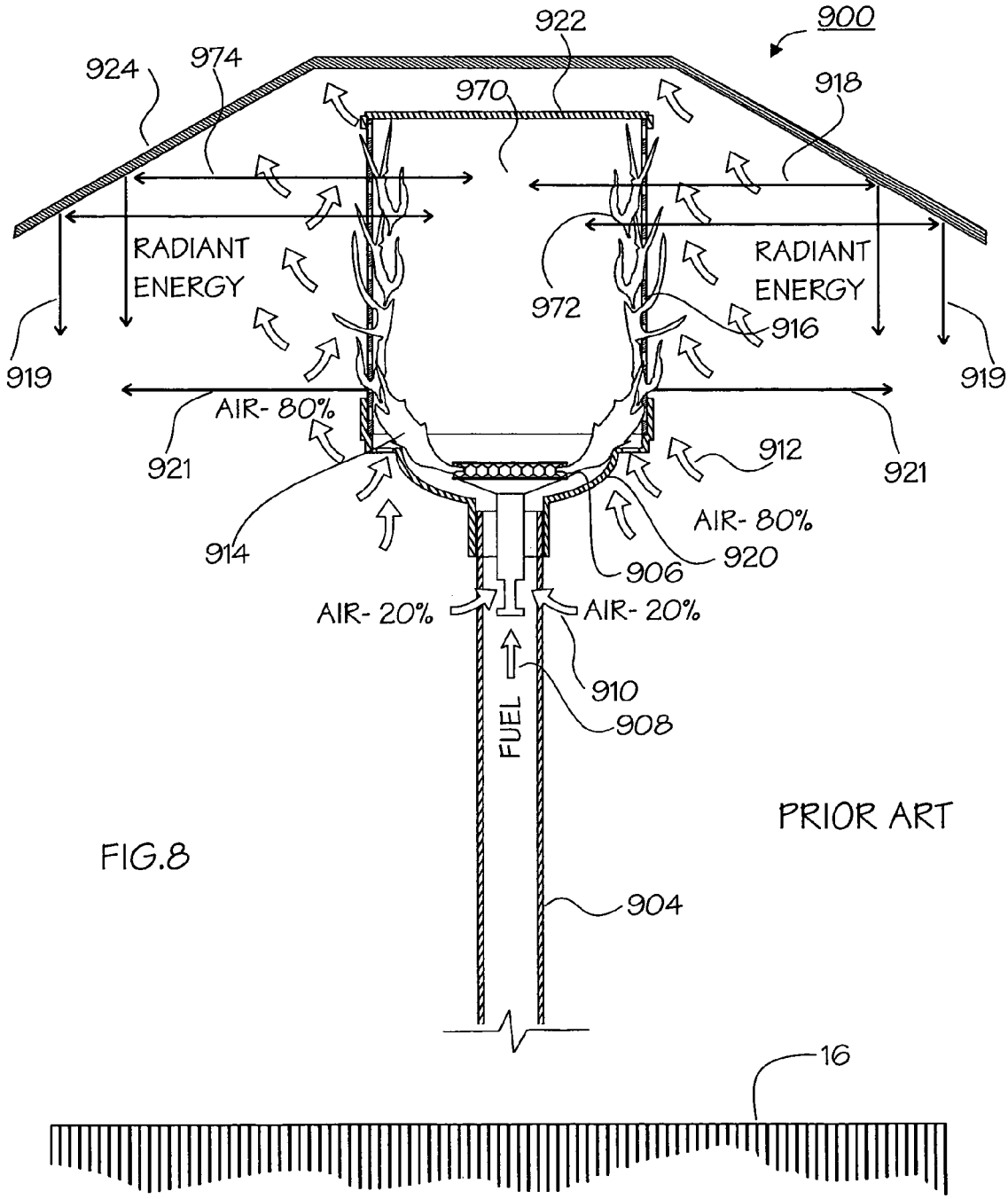
FIG.8 PRIOR ART
FIG. 8 is a schematic cross sectional view of a mushroom-type prior art radiant heater showing the burner configuration.
Figure 9:
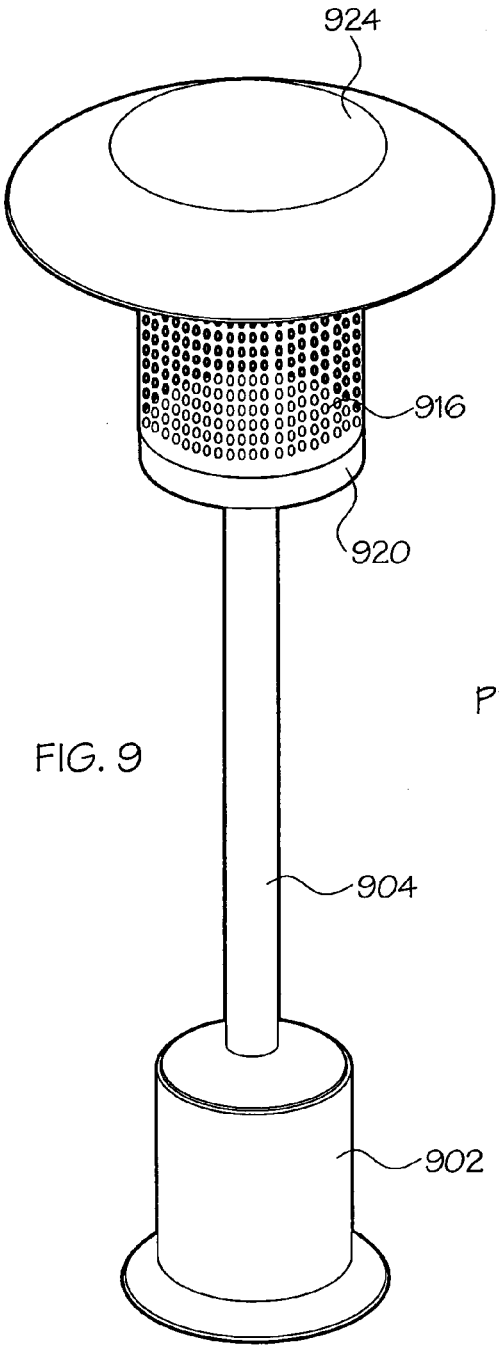
FIG. 9 PRIOR ART
FIG. 9 is a top schematic perspective view of the heater shown in FIG. 9.
Figure 10:
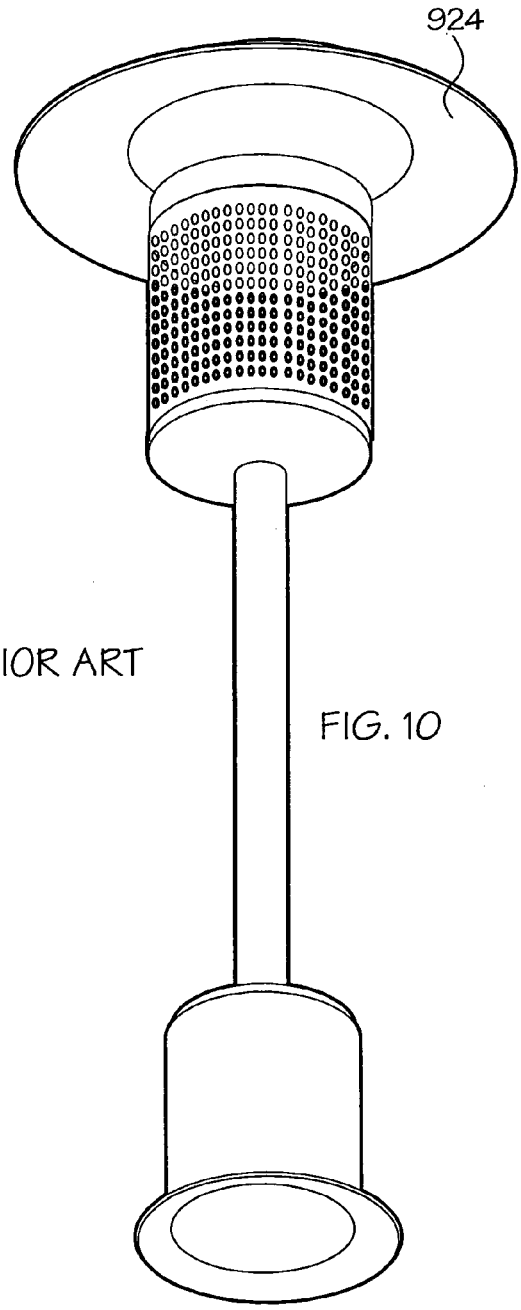
FIG. 10 is a bottom schematic perspective view of the prior art radiant heater shown in FIG. 8.

Hence as shown in the graph of FIG. 7, reversing the heat source 12 to radiate heat opposite the surface 16 and towards the deflector 14 for the redistribution of this heat assures a greater uniformity of the hot point on a much greater surface 16.

In the non-limiting examples illustrated herein, the heat source 12 and the deflector 14 are shown to be spaced above a target surface 16. Of course, the heat source 12 and the deflector 16 can be spaced from a given target surface in a variety of ways, whether laterally, below or spaced at an angle from the target surface depending on the positioning of that surface as well as the given application of the invention.

The heat deflector 14 may be provided in a variety of configurations in order to permit a uniform heating of a wide area of a given target surface. Furthermore, the deflector may be provided in a variety of deflecting materials, such as without limitation aluminum, stainless steel and other highly reflective materials as can be contemplated by the skilled artisan, capable of deflecting heat in accordance with the present invention.

The heat source 12 may include a variety of electric or gas heaters, as is known in the art.

The positioning, the distance between the deflector 14 and the heat source 12, their configuration and size as well the material of deflector 14 and the intensity of the heat are a function of the surface area that is to be heated, the environment of that surface area as well as the comfort and personal tastes of the users.

It is to be understood that the invention is not limited in its application to the details of construction and parts illustrated in the accompanying drawings and describes herein above. The invention is capable of other embodiments and of being practised in various ways. It is also to be understood that the phraseology or terminology used herein is for the purpose of description and not limitation. Hence, although the present invention has been described herein above by way of preferred embodiments thereof, it can be modified, without departing from the spirit, scope and nature of the subject invention as defined in the appended claims.

Figure 13:
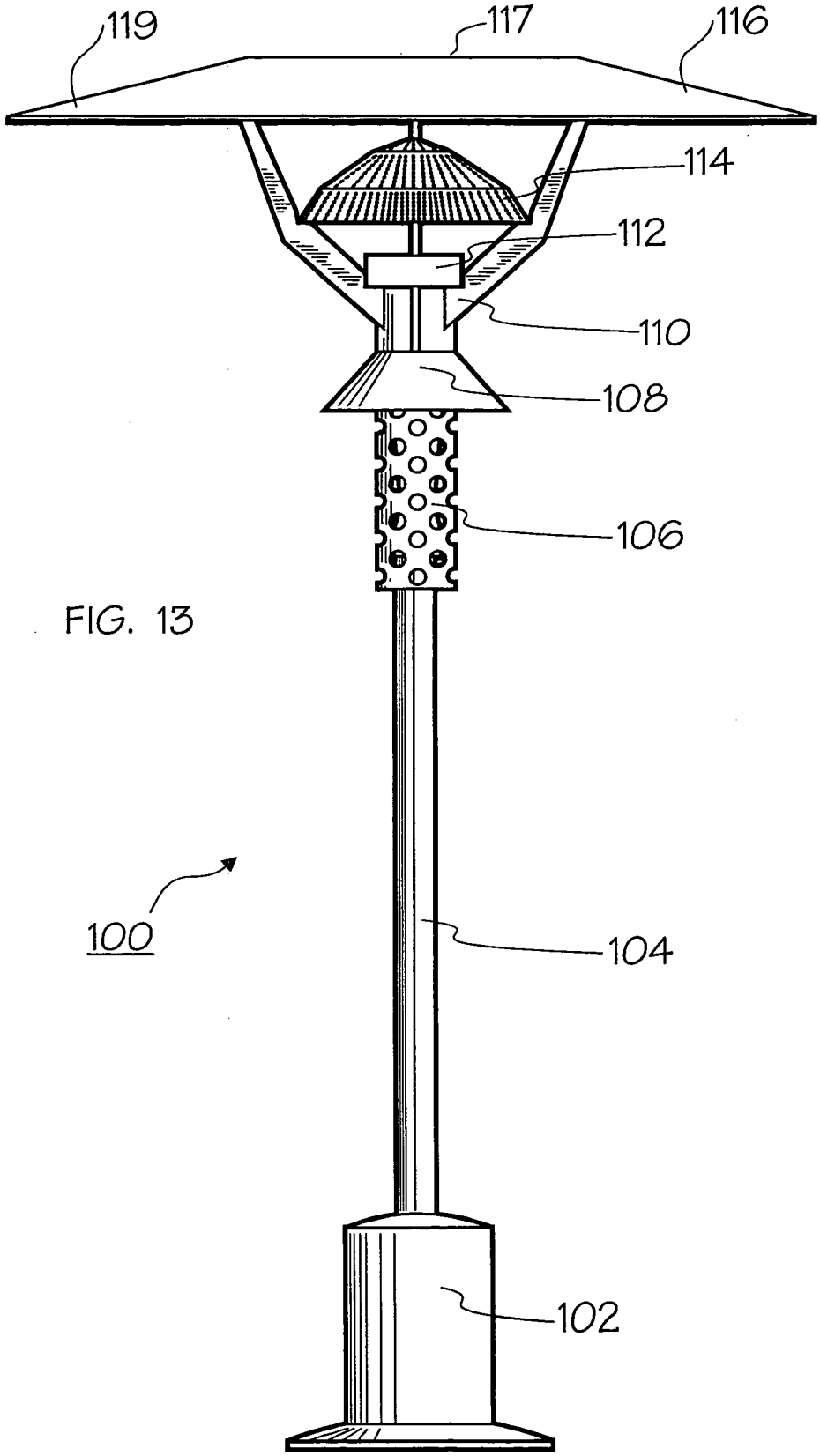
FIG. 13 is a schematic plan elevational view of one embodiment of the present invention a radiant heater 100.
Figure 17:
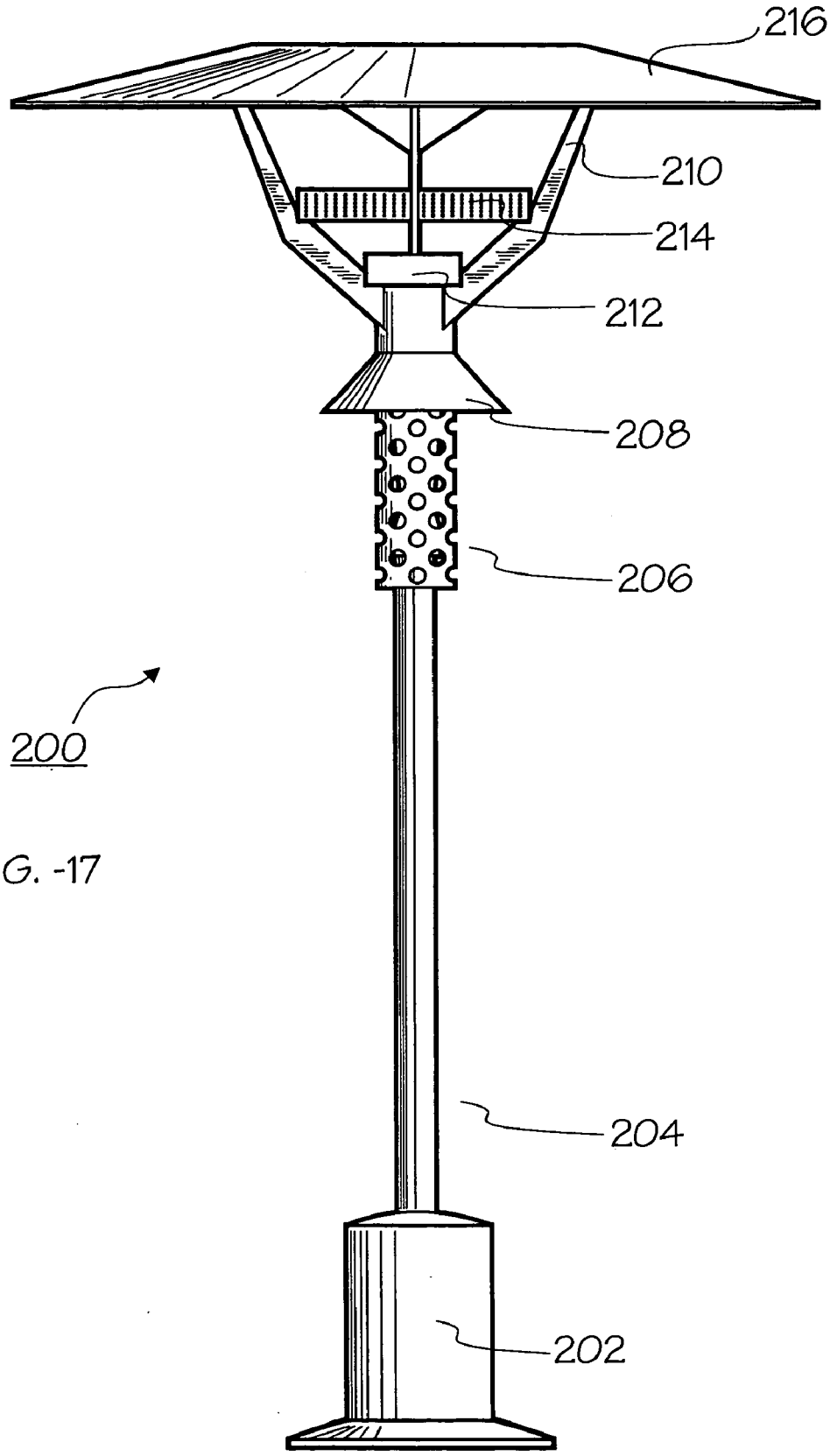
FIG. 17 is a schematic side elevational view of the another embodiment of the present invention a radiant heater 200.
Figure 21:
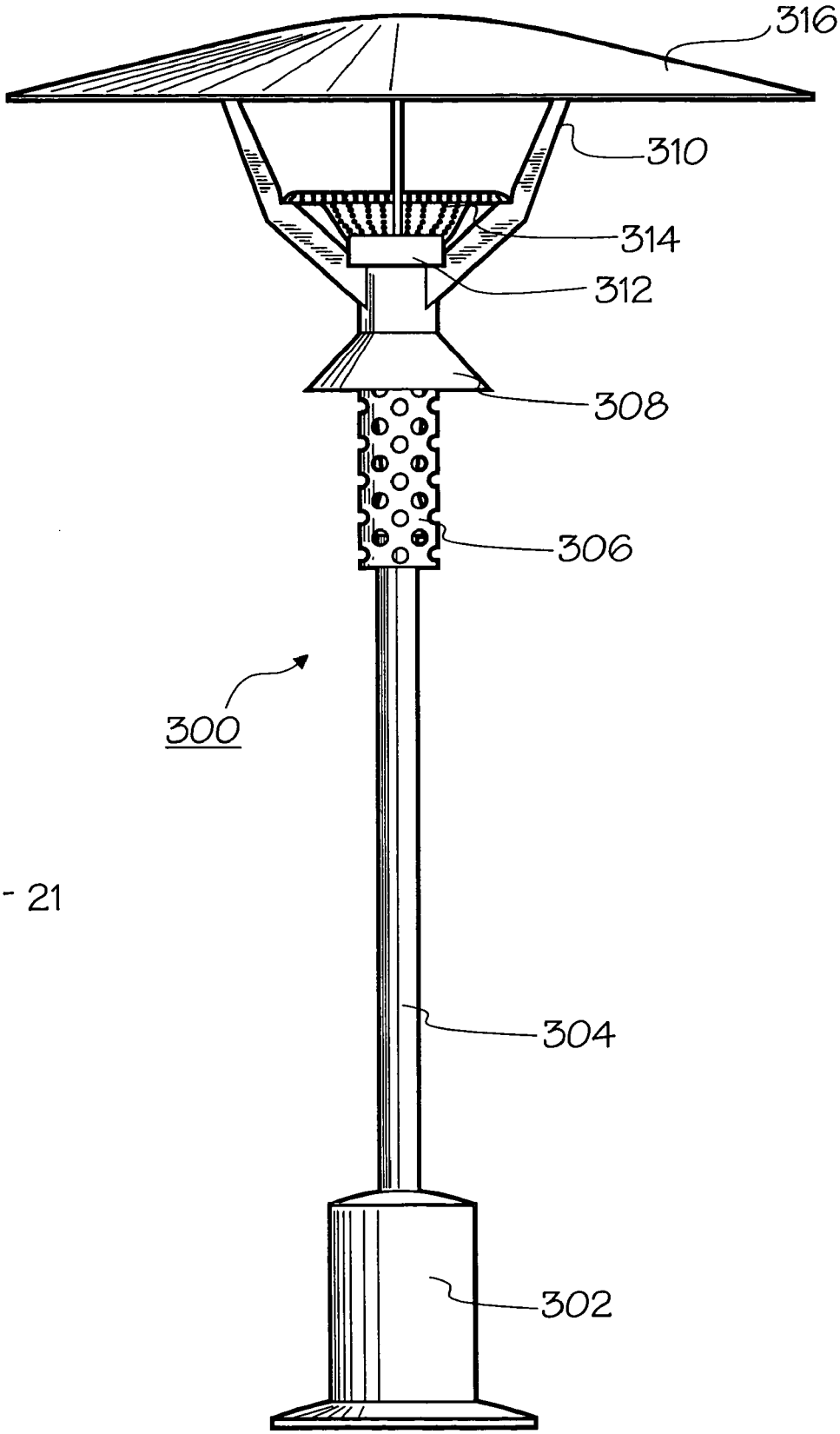
FIG. 21 is a schematic front elevational view of another embodiment of the present invention a radiant heater shown as 300.

The present invention also includes three embodiments depicted and shown in FIGS. 13, 17 and 21. The first embodiment is shown in FIGS. 13 through 16, the second embodiment is schematically depicted in FIGS. 17 through 20 and the third embodiment is schematically depicted in FIGS. 21 through 24.

The present invention shown as radiant heater 100, 200, 300 in FIGS. 13 through 24 includes the following major components, namely base 102, 202, 302, column, 104, 204, 304, air inlet cover, 106, 206, 306, deflector 108, 208, 308, arms 110, 210, 310, flame jacket 112, 212, 312, emitter 114, 214, 314 and deflector 116, 216 and 316. One will note that most features are common to all three embodiments depicted with the major variation in the radiant heater design being the shape of the emitter 114, 214 and 314 and matching deflector namely 116, 216 and 316.

The deflector positioned above said emitter including in cross section a central circular flat section, and attached to the outer periphery of the central flat section an outer downwardly sloped section as shown in FIGS. 13 to 16. Deflector 116 includes the central circular flat section 117 and the outer sloped section 119 in order to redirect direct emissions 120 in optimal fashion. Deflector 216 includes in cross section a central inverted conical section 217 and attached to the outer periphery of the central conical section a outer downwardly sloped section 219 as depicted in FIGS. 17 to 20. Deflector 316 is in cross section an inverted conical section as depicted in FIGS. 21 to 24.

Figure 14:
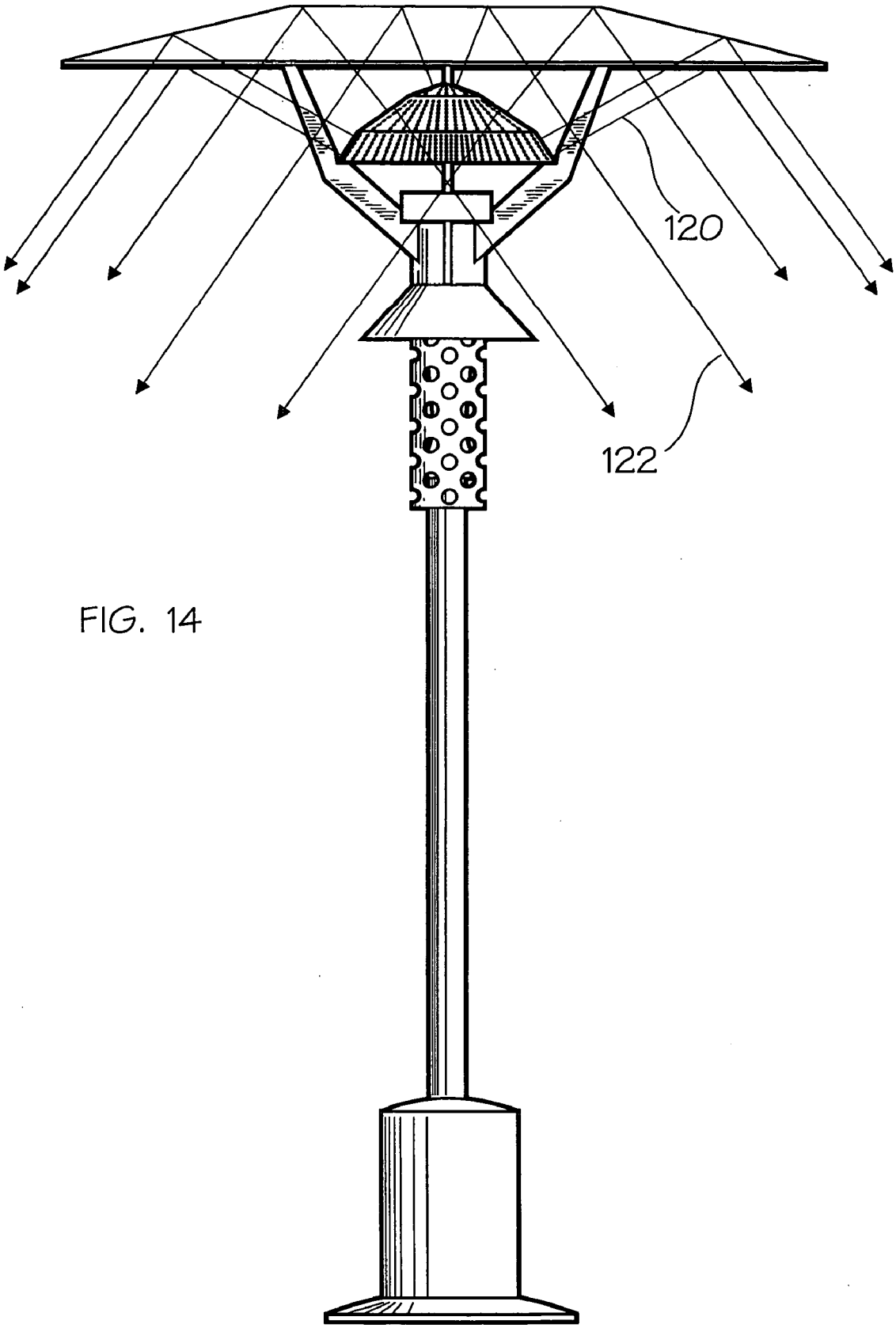
FIG. 14 is a schematic plan elevational view of the radiant heater shown in FIG. 13 depicting direct and reflected emissions from the heater.
Figure 15:
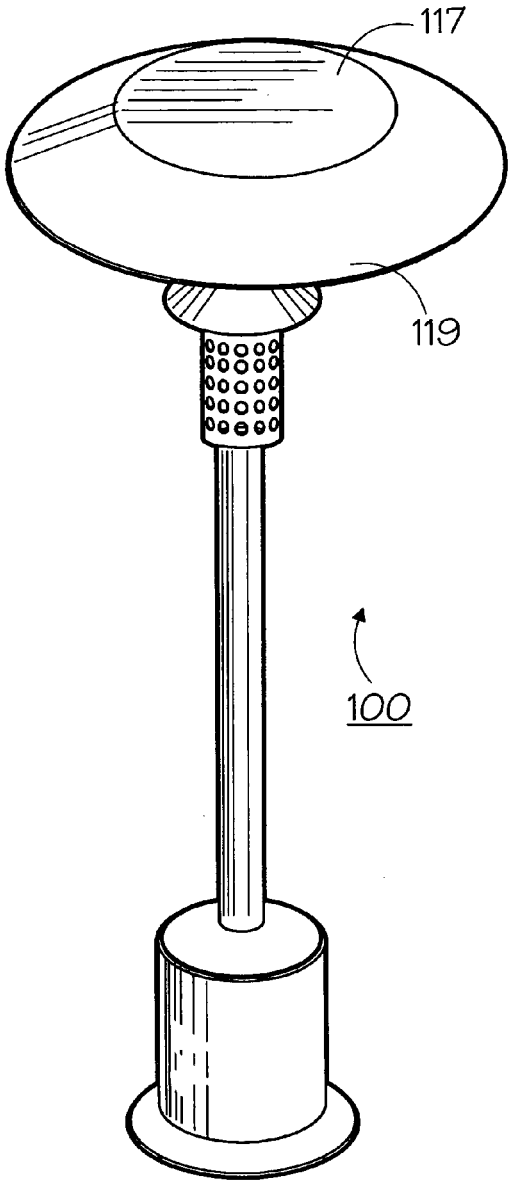
FIG. 15 is a top perspective schematic view of the heater shown in FIG. 13.
Figure 16:
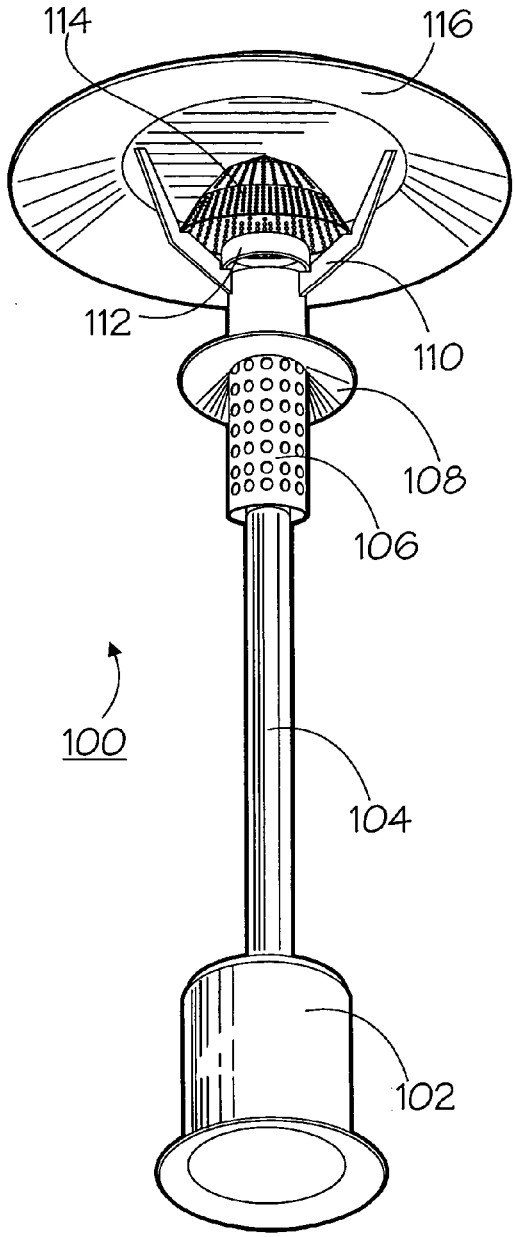
FIG. 16 is a bottom schematic perspective view of the heater shown in FIG. 13.
Figure 18:
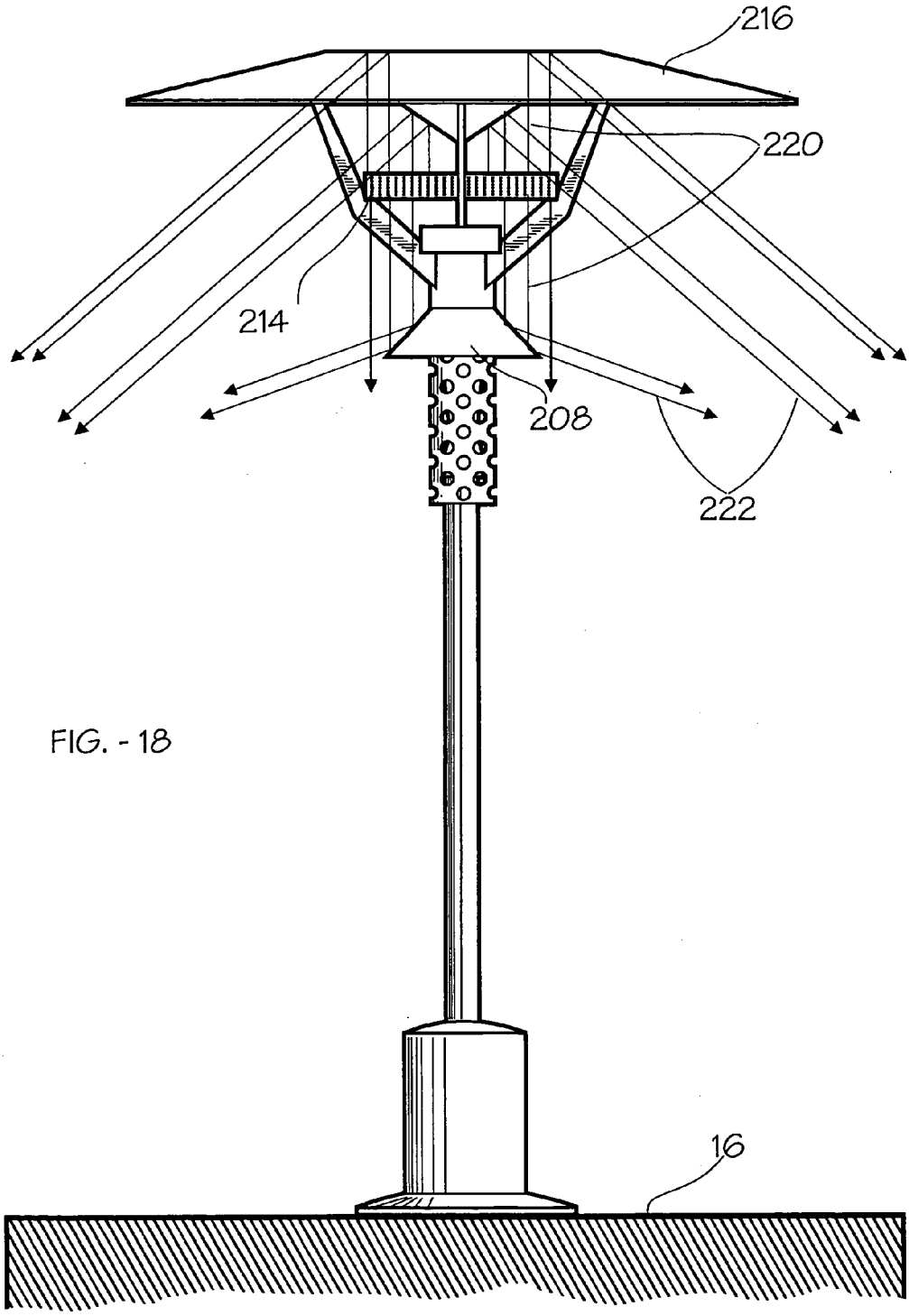
FIG. 18 is a schematic plan elevational view of the radiant heater shown in FIG. 17 depicting direct and reflected emissions from the heater.
Figure 19:
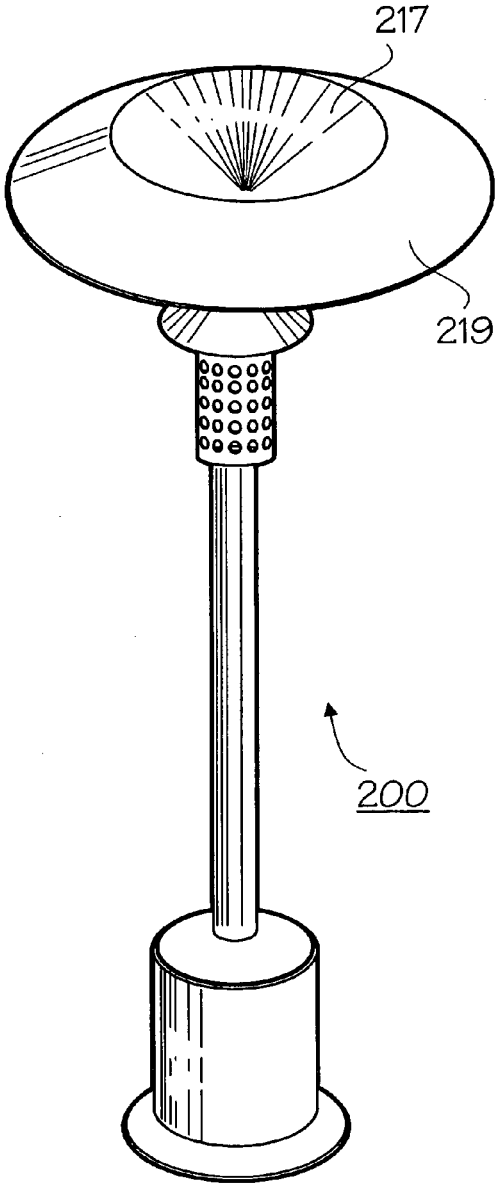
FIG. 19 is a top perspective schematic view of the heater shown in FIG. 17.
Figure 20:
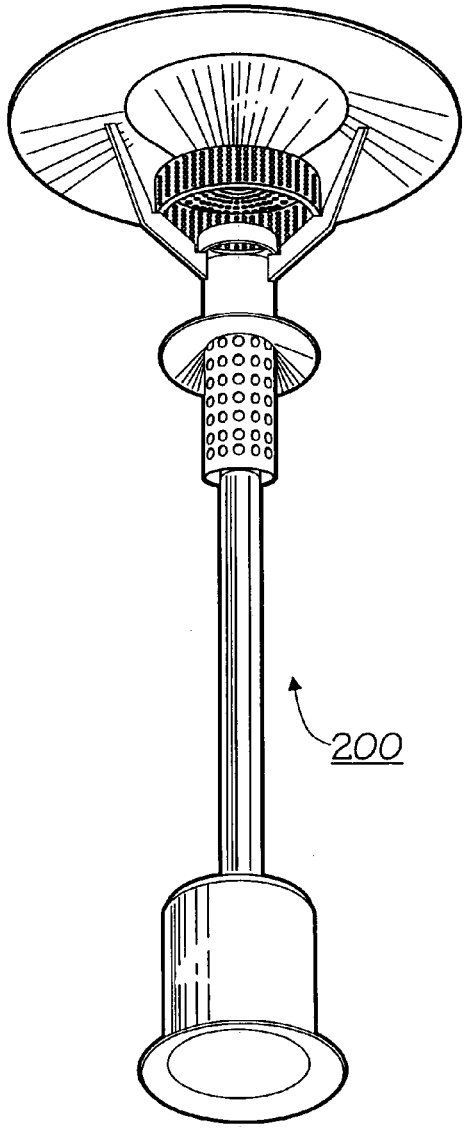
FIG. 20 is a bottom schematic perspective view of the heater shown in FIG. 17.
Figure 22:
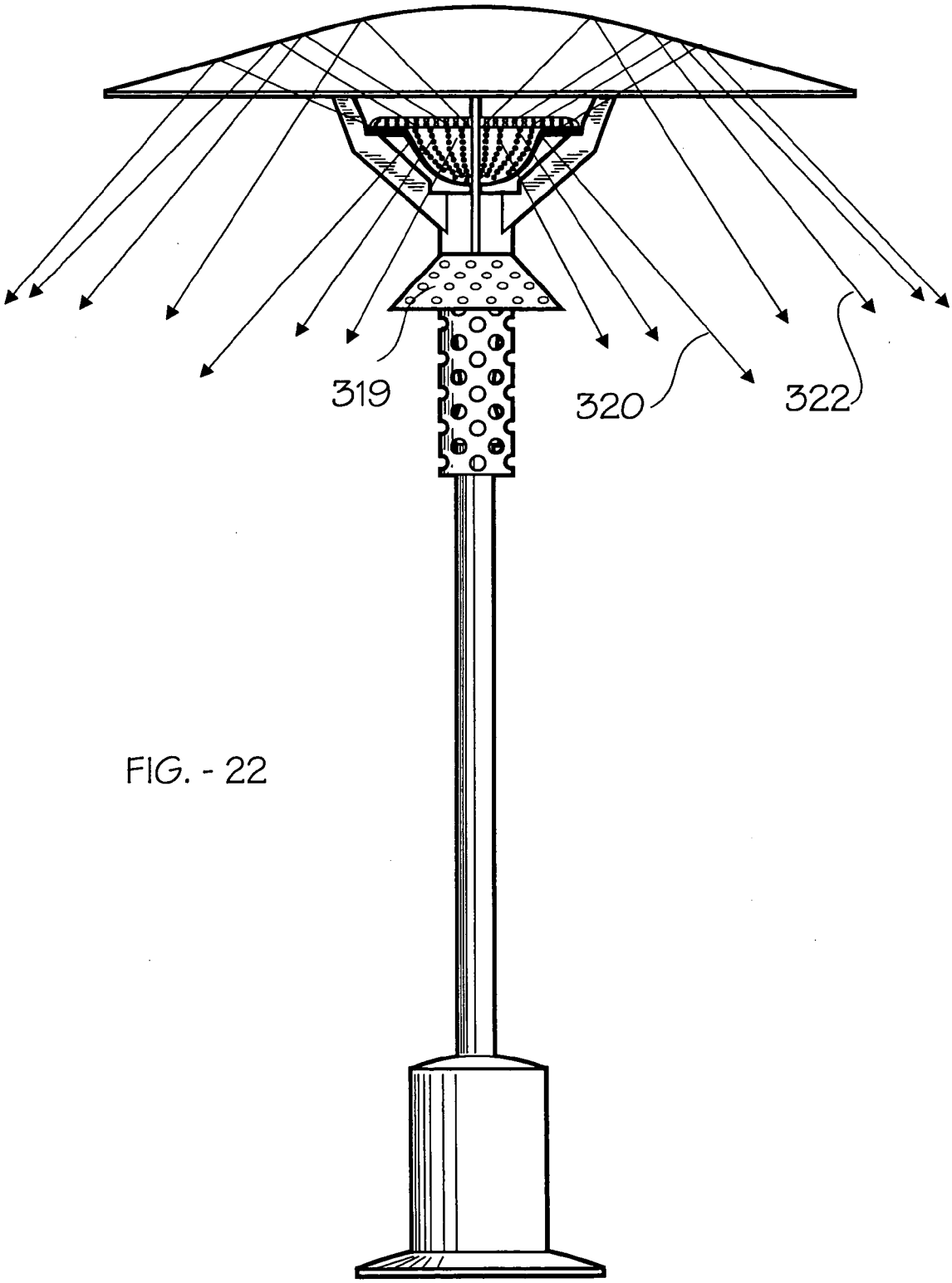
FIG. 22 is a schematic plan elevational view of the radiant heater shown in FIG. 21 depicting direct and reflected emissions from the heater.
Figure 23:
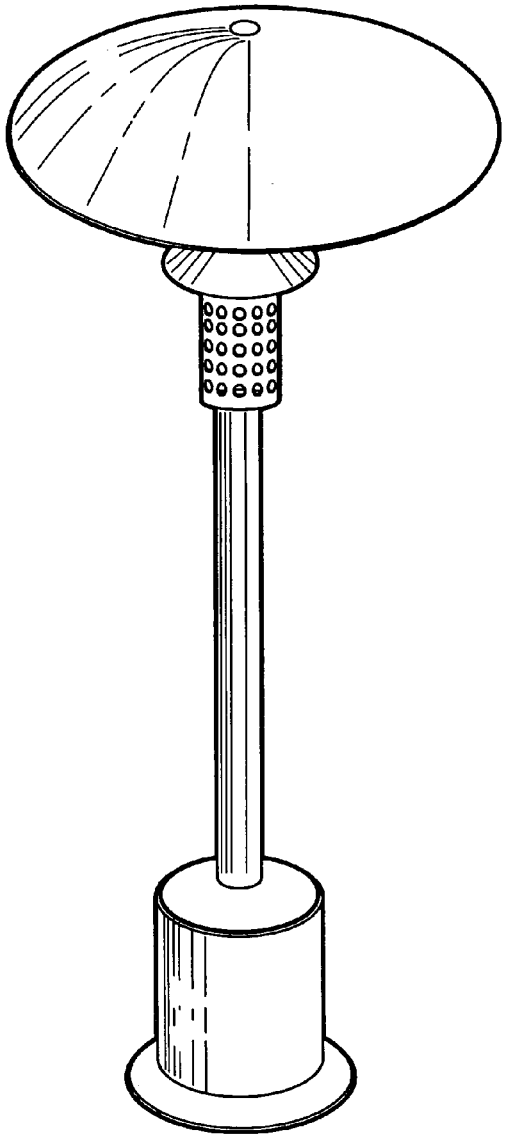
FIG. 23 is a top perspective schematic view of the heater shown in FIG. 21.
Figure 24:
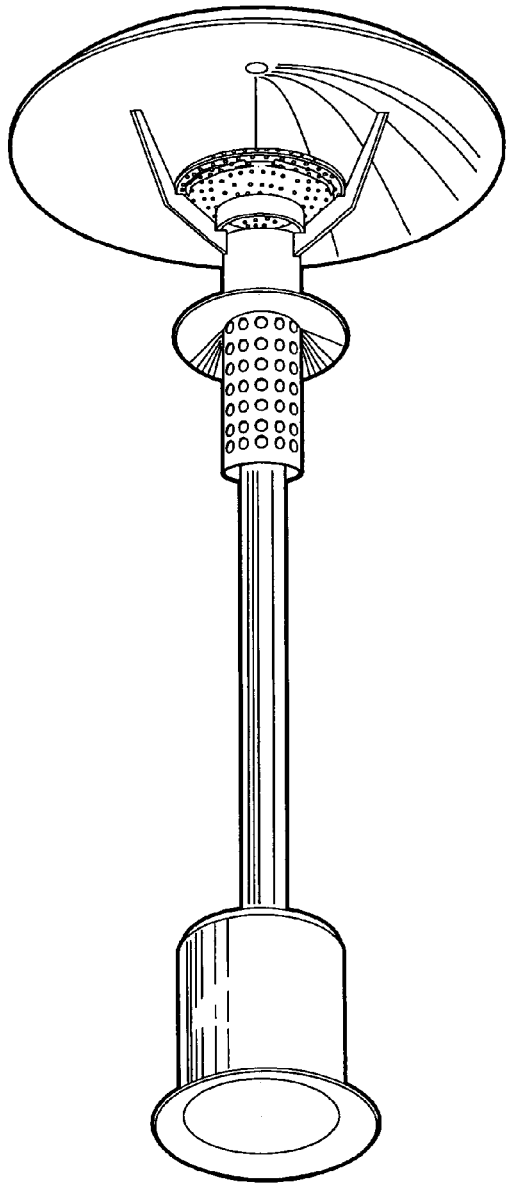
FIG. 24 is a bottom schematic perspective view of the heater shown in FIG. 21.

Referring now to FIGS. 14, 18 and 22. These Figures show the radiant emissions from the emitters of each radiant heater as direct emissions 120, 220 and 320 and reflected emissions 122, 222 and 322 respectively. Direct emissions are radiant heat waves and are also referred to as radiant flux being emitted from each of the emitters 114, 214 and 314, whereas the reflected emissions denoted as 122, 222 and 322, are radiant emissions or radiant flux waves as reflected by each of the deflectors 116, 216 and 316 respectively. In FIGS. 3, 4 and 5 these radiant emissions are referred to as waves 46 which is analogous to direct emissions 120 and waves 48 which is analogous to reflected emissions 122. Reflected emissions 122, 222 and 322 may also be reflected by deflectors 108, 208 or 308.

Referring now to FIGS. 25 through 33 which depicts the emitters 114, 214, 215 and 314 respectively, emitters 114 and 314 each can be divided into three sections, namely inner portion 124 and 324, middle portion 126 and 326 and outer portion 128 and 328. The inner portion 124 and 324 being closest to the flame tends to be heated most efficiently and therefore the number of perforations 130 in the inner portion is less than the number of perforations 130 in for example, the outer portion 128 and 328. In this manner by increasing the number of perforations 130 as one moves away from the centre to the outer portion of the emitter, one can to some extent improve the temperature uniformity of the emitter. The emitter naturally tends to be hottest at the inner portion 124 and 324 and coolest at the outer portion 128 and 328. In order to compensate for this uneven heat distribution across emitter 114 and/or 314, the density of perforations 130 increases as one moves from the inner portion 124 and 324 to the outer portion 128 and 328. The same is true of perforations 130, 230, and 330.

Figure 25:
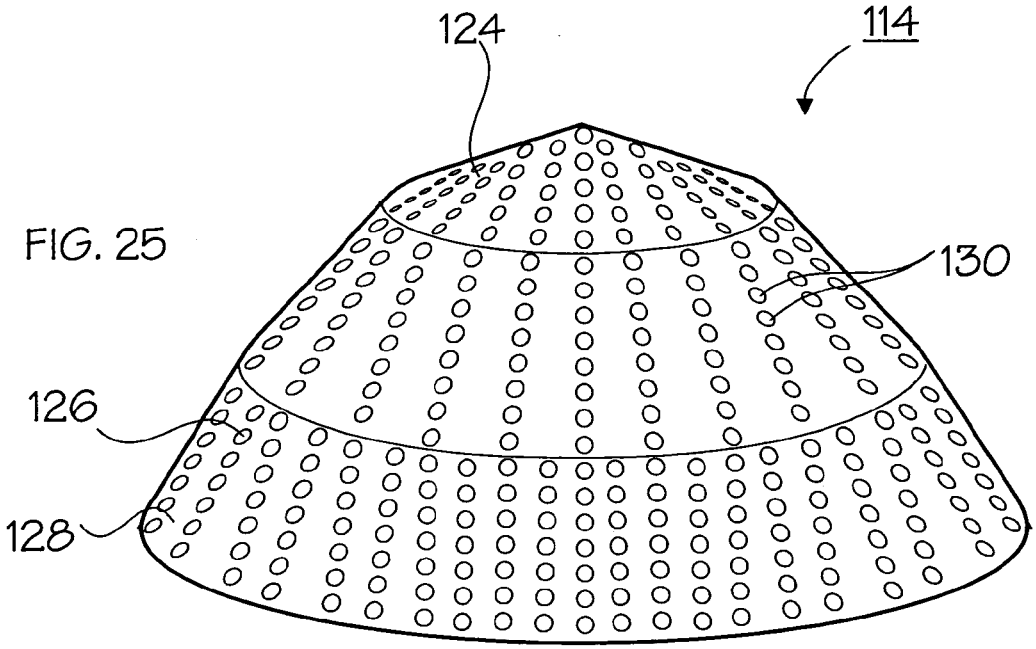
FIG. 25 is a top perspective view of the emitter 114 as shown deployed in FIG. 13.
Figure 26:
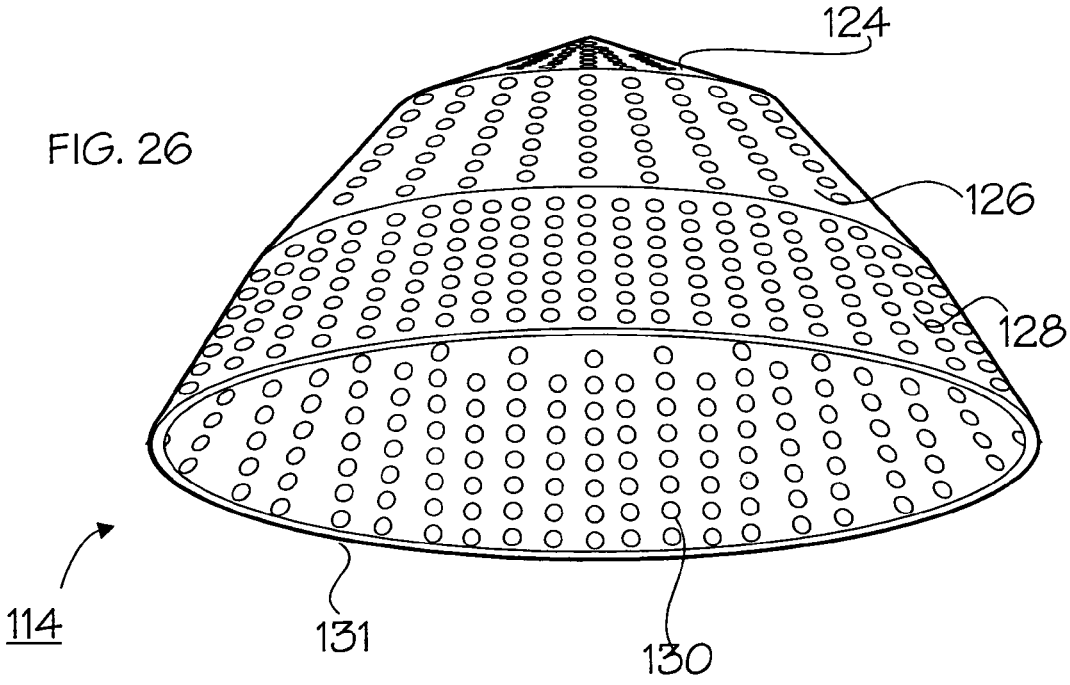
FIG. 26 is a bottom schematic perspective view of the emitter 114 as shown deployed in FIG. 13.
Figure 31:
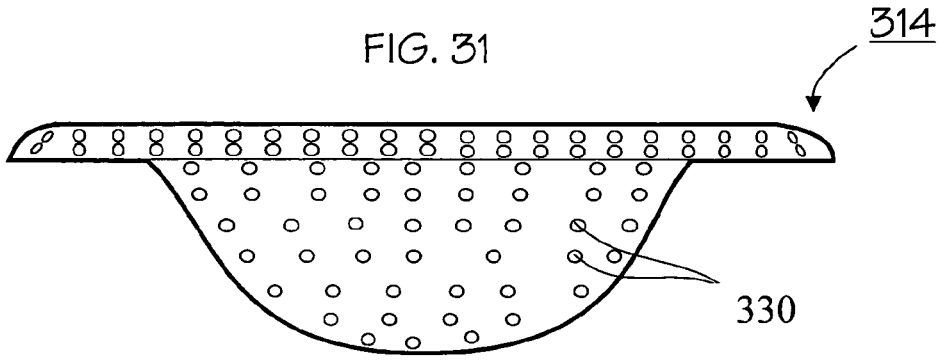
FIG. 31 is a side elevational view of the emitter 314 as shown deployed in FIG. 21.
Figure 32:
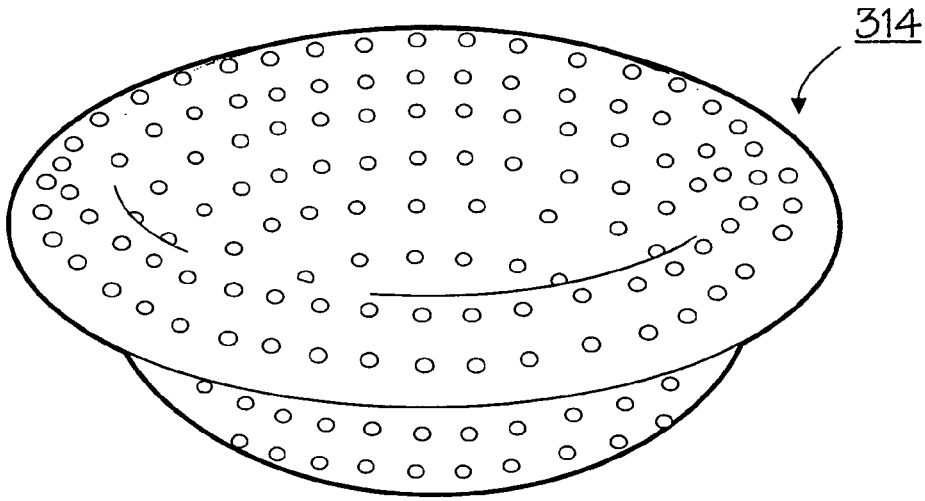
FIG. 32 is a top schematic perspective view of the emitter 314 shown deployed in FIG. 21.
Figure 33:
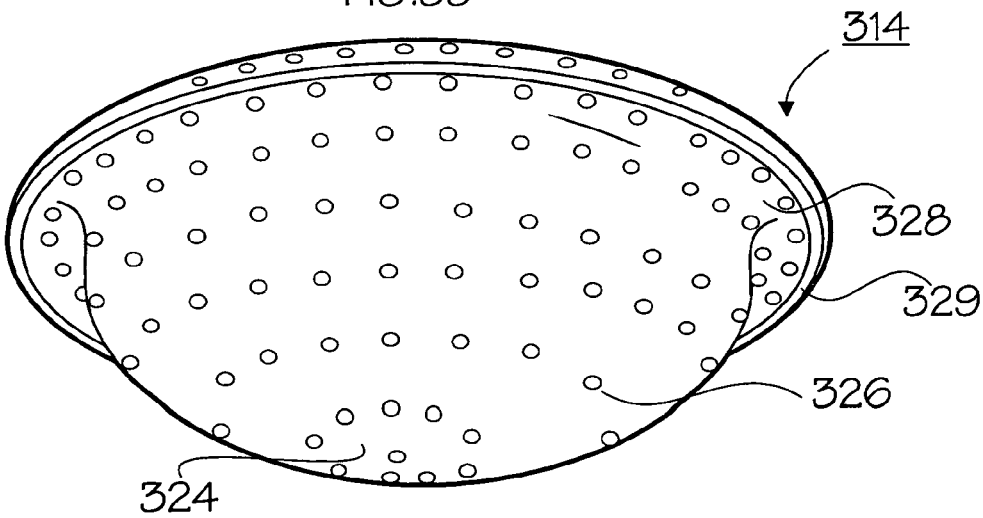
FIG. 33 is a bottom perspective schematic view of the emitter 314 as shown deployed in FIG. 21.

Emitter 114 is an inverted conical section with each portion being more steeply sloped as one moves toward the outer rim 131. Inner portion 124 being gently sloped, middle portion 126 having a greater slope and outer portion 128 being steeply sloped as depicted in FIGS. 13 and 25.

Emitter 214 has a flat circular section 225 which terminates at a cylindrical outer flange 228. The number and density of perforations 230 is least in inner portion 226 of flat circular section 225 and increases as one moves outwardly along middle portion 226. Optionally emitter 215 may include a ring shaped bottom flange 232 as depicted in FIG. 29.

Emitter 314 has an upstanding U or bowl shaped conical section making up the inner and outer portion 324 and 326 of emitter 314, said bowl section preferably terminating in a down turned outer rim 329 at outer portion 328.

Referring now to FIGS. 27 through 30. The emitter 214 shown in FIGS. 27 and 28 includes an inner portion 224, a middle portion 226 and an outer flange 228. Analogous to emitters 114 and 314, the number of perforations 230 increases as one moves from the inner portion to the outer portion. Optionally, a bottom flange 232 can also be included with emitter 215 for flame retention, thereby further providing for greater uniformity of heat and temperature distribution of emitter 215.

A person skilled in the art will note that each emitter is matched to a specific deflector.

Figure 11:
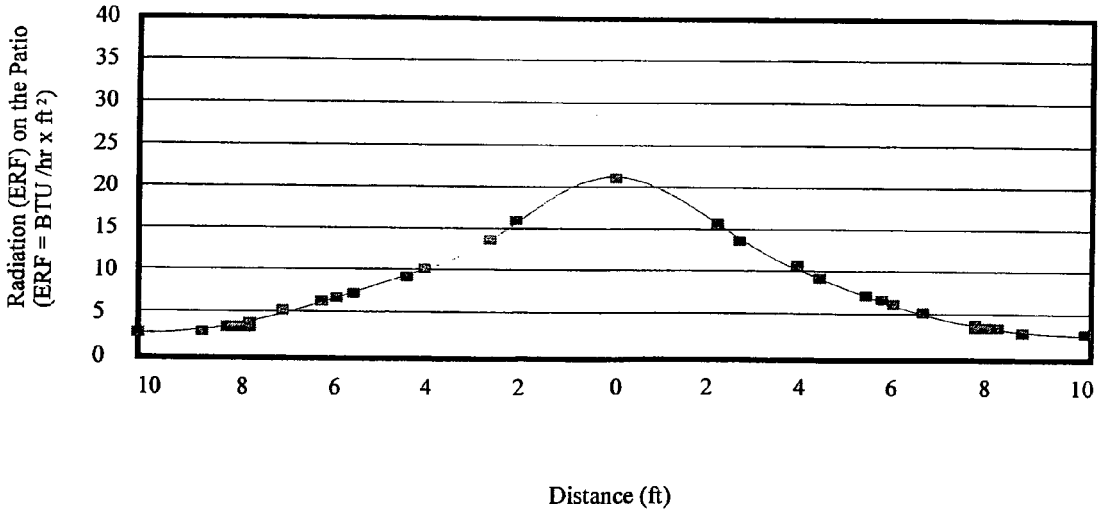
FIG. 11 PRIOR ART
FIG. 11 is a two dimensional graph representing the heating profile of a mushroom-type prior art heater as is also depicted in a three dimensional view shown in FIG. 1. The units of the X axis is in feet, the distance from the centre of the radiant heater, whereas the Y axis is in btu's per hour foot squared which are units of effective radiant flux reaching objects at a surface 16 as shown in FIG. 3.
Figure 12:
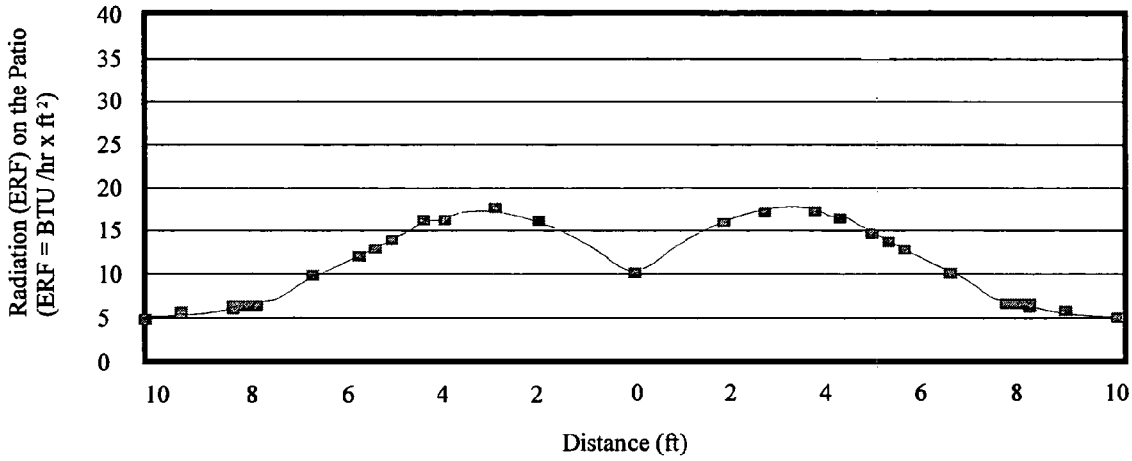
FIG. 12 is a two dimensional graph showing the heat-distribution of a radiant heater in accordance with the present invention as is also shown in three dimensions in FIG. 7 having the units along the X axis of feet from the centre of the radiant heater and on the Y axis btu per hour feet squared which is the effective radiant flux reaching objects sitting at a surface 16 as shown in FIG. 3.
Figure 12A:
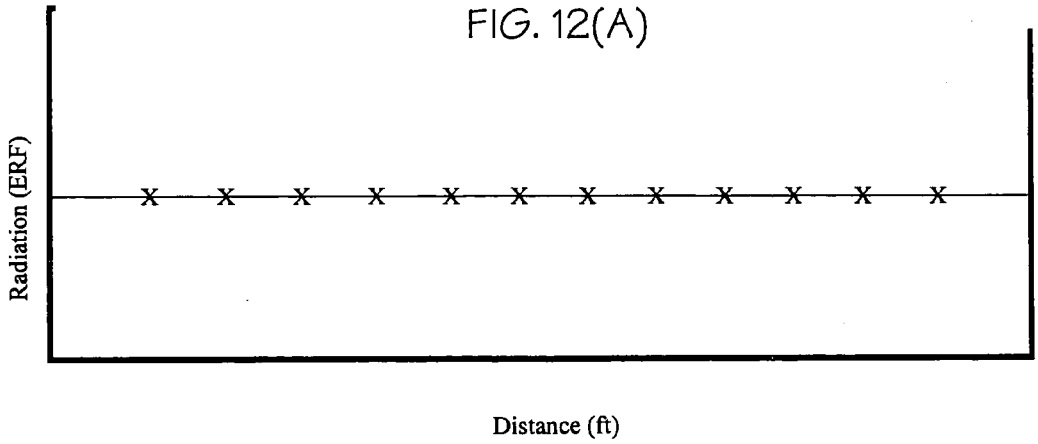

Radiant emissions generally are emitted perpendicular to the hot or the emitter surface and therefore, in order to uniformly heat the surface which one is attempting to heat, as for example surface 16 in FIG. 3, 4 or 5, one attempts to evenly direct reflected and direct emissions onto surface 16 in order to obtain the ideal heat profile as shown in FIG. 12(*a*). In practise, this is virtually impossible, however by matching the emitter 114 with the deflector shape 116, one can obtain a more uniform effective radiant flux distribution as shown in FIG. 12 versus the prior art effective radiant flux distribution shown in FIG. 11. With the prior art radiant heater type devices, the temperature tends to be hottest immediately below the heater itself, whereas, with the presently invented radiant heater devices, the temperature distribution tends to be more uniform. The warmest or the greatest amount of effective radiant flux tends to occur at two to four feet away from the radiant heater itself which is a desirable characteristic for a radiant heater, particularly if they are used in patio type environments.

Referring now to FIGS. 40 through 43, which schematically depicts a partial cross sectional view of the burner portion of the radiant heaters shown as radiant heater 100, 200 and 300 respectively. Burner 101, 201 and 301 includes the following major components, namely gas 144, 244 and 344 enters gas conduit 142, 242 and 342 and exits via gas orifice 246. Primary combustion air 250 is drawn in through air inlets 240 of air inlet cover 206. Venturi 248 mounted within air inlet cover 206 draws both gas 144, 244 and 344 and primary combustion air 250 along side gas orifice 246 and provides for mixing of the primary combustion air 150, 250 and 350 and the gas 144, 244 and 344 within mixing chamber 152, 252 and 352 defined by venturi 148, 248 and 348. Combustion occurs at or near flame retainer 156, 256 and 356 at the top of venturi 148, 248 and 348 and creates a rising flame 158, 258 and 358 and additional secondary combustion air 154, 254 and 354 is drawn into flame 158, 258 and 358 where any residual gas 144, 244 and 344 which is unburned is now combusted. Optionally, a flame jacket 112, 212 and 312 is included which preferably is made out of a heat resistant glass which additionally helps to channel the combustion gases and the flame 158, 258 and 358 towards emitter 114, 214 and 314. Optionally, a deflector 108, 208 and 308 is mounted onto air inlet cover 106, 206 and 306 for additional deflection of radiant emissions from emitter 114, 214, 215 and 315 and optionally holes 219 are included in deflector 208, allowing some of the radiant emissions to pass through deflector 208.

A person skilled in the art will note that the components of burners 101, 201 and 301 are almost identical in nature and common to all three burners, except for the shape of the emitter 114, 214 and 314 and the associated matched deflector 116, 216 and 316.

As mentioned flame jacket 112, 212 and 312 and deflector 208 are optional features and may or may not be included with each of the burners 101, 201 and 301.

Figure 44:
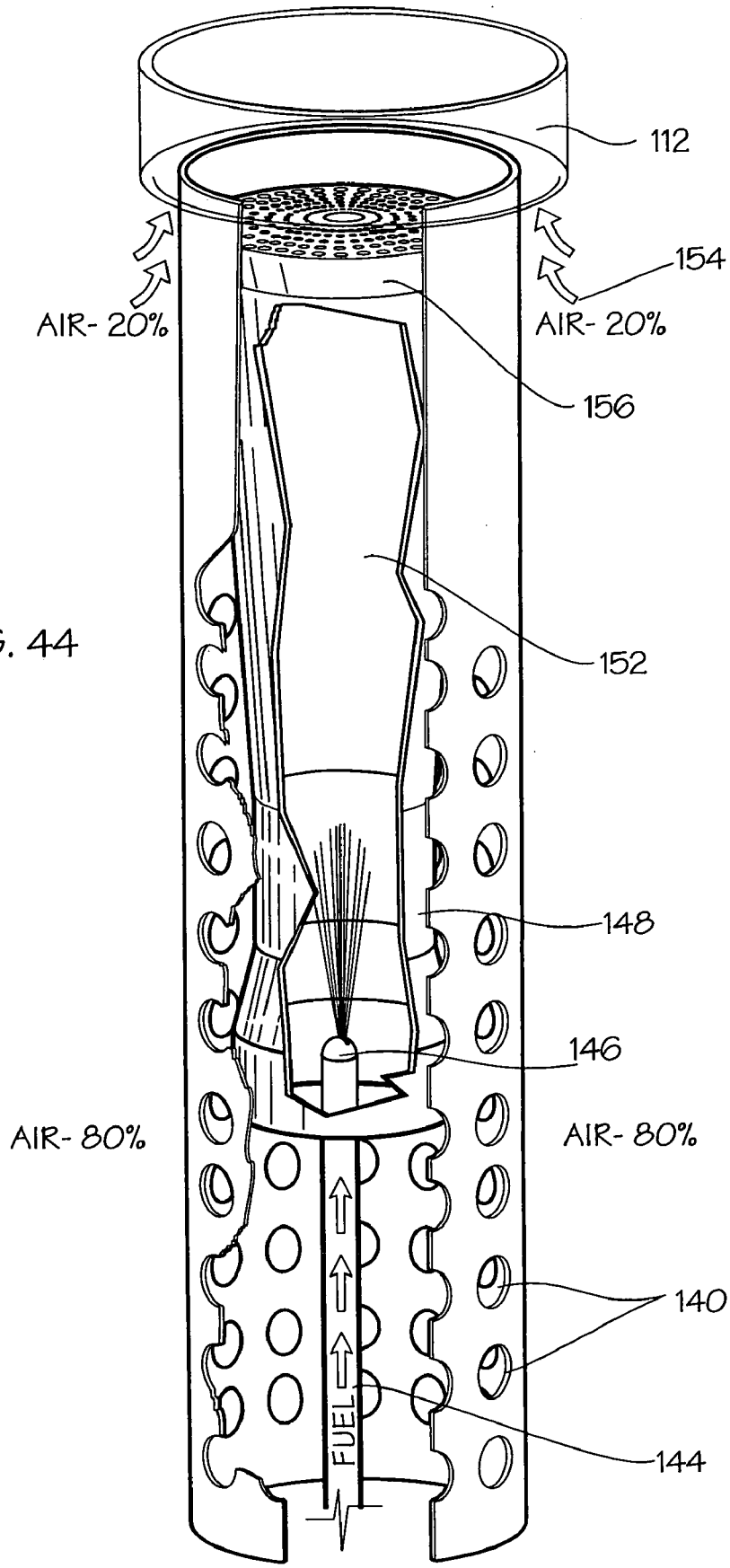
FIG. 44 is a partial schematic cut away upright perspective view of some burner components, particularly showing the details of the venturi, flame retainer, air inlets, cover, flame jacket, gas orifice and gas conduit.

Individual specific components of the various burners 101, 201 and 301 are depicted in FIG. 34 through 39 and also in FIG. 44.

Venturi 148,248 and 348 is so designed to optimize the mixing of gas 144, 244 and 344 with primary combustion air 150, 250 and 350. The length of venturi 148, 248 and 348 and the size of mixing chamber 152, 252 and 352 are optimized to maximize mixing of gas 144, 244 and 344 with primary combustion air 150, 250 and 350.

In Use

FIGS. 1, 8, 9 and 10 depict the prior art mushroom type heater which is currently widely used. A person skilled in the art will recognize that the prior art emitter 916 has vertically disposed emitter surfaces which essentially give off radiant emissions perpendicular to the emitter surface 916 as shown schematically as radiant waves 918 (also referred to as direct emissions). Substantially all the direct emissions 918 travel in a horizontal direction as depicted by direct emissions 918 and do not heat the surface which one wants to heat namely, surface 16 as depicted in FIGS. 3, 4 and 5. Only reflected emissions 919 are deflected downwardly to directly heat surface 16. As a result the effective radiant flux distribution shown in three dimensions in FIG. 1 and in two dimensions in FIG. 11, shows the greatest amount of effective radiant flux impingement occurs in close proximity to column 904 of prior art radiant heater 900 with the effective radiant flux distribution falling off very rapidly as one moves away from column 904 of prior art radiant heater 900. As indicated the theoretical perfect effective radiant flux heat distribution is as shown in FIG. 12(*a*), namely a constant effective radiant flux irrespective of the distance away from the radiant heater.

The poor effective radiant flux distribution as shown in FIG. 11, can be attributed to the burner 906 design, the emitter 916 design, as well as the deflector 924 design.

Prior art radiant heater 900 uses a small amount of primary combustion air 910 typically of the order of 20% and uses a very high amount of secondary combustion air 912 of the order of 80% and this type of burner arrangement creates a very soft flame 914 which develops along emitter surface 916. The very soft puffy flame 914 is easily disturbed by ambient wind conditions. Since many of these radiant heaters 900 are used outdoors on patios for example, it is desirable to have a very stable flame 914 in order to main emitter 916 at a very constant and uniform temperature. Emitter 916 of radiant heater 900 tends to be very non-uniform in temperature namely there are noticeable cold spots near top cover 922 and near lower cover 920, and it tends to be hottest in the centre portion of emitter 916. In addition any wind can quickly disturb flame 914 immediately cooling down emitter 916 once again reducing the amount of radiant emissions emitted from emitter 916. Therefore, prior art radiant heater 900 has difficulty maintaining a uniform emitter temperature, particularly in windy, outdoor conditions and secondly provides for a very poor effective radiant flux distribution as shown in FIG. 11, thereby resulting in a poor comfort level for persons and/or objects being heated adjacent to prior art radiant heater 900 on surface 16.

Hot emitting body such as emitter 916, emits radiant waves or direct emissions 918 both outwardly as shown as exterior emissions 974 as well as inwardly shown as interior emissions 972 into the interior 970 of emitter 916. Interior emissions 972 of emitter 916 are essentially wasted in that these interior emissions 972 cannot be directed outwards onto surface 16 in order to provide comfort and heating as required. Interior emissions 972 do not add to the effective radiant flux distribution as shown in FIG. 11, and therefore do not create any additional heating onto surface 16. In this manner, prior art radiant heater 900 is only utilizing one surface of emitter 916, namely the exterior surface which provides for exterior emissions 974. The interior surface of emitter 916 which provides for interior emissions 972 are essentially not utilized.

Furthermore, emitter 916 is screen material with uniform perforations along its entire surface area. These uniform perforations are not optimized to provide for a more uniform emitter temperature 916. As already mentioned, the portion closest to lower cover 920 and top cover 922 tends to be coolest, whereas the emitter tends to be hottest approximately ⅓ of the distance above burner 906.

The Present Invention

Figure 40:
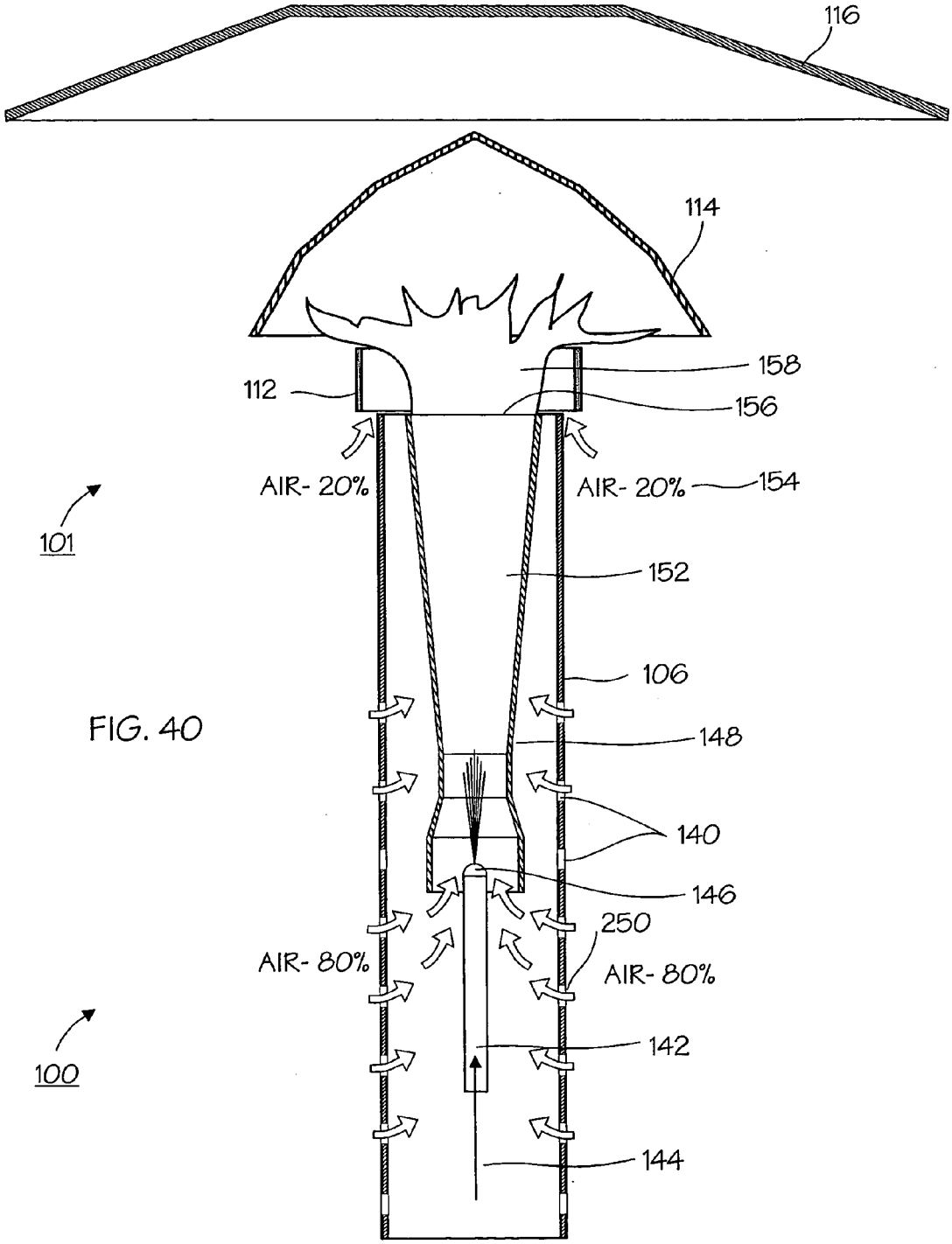
FIG. 40 is a partial schematic cross sectional view of the burner components of the radiant heater 100 as depicted in FIG. 13.
Figure 41:
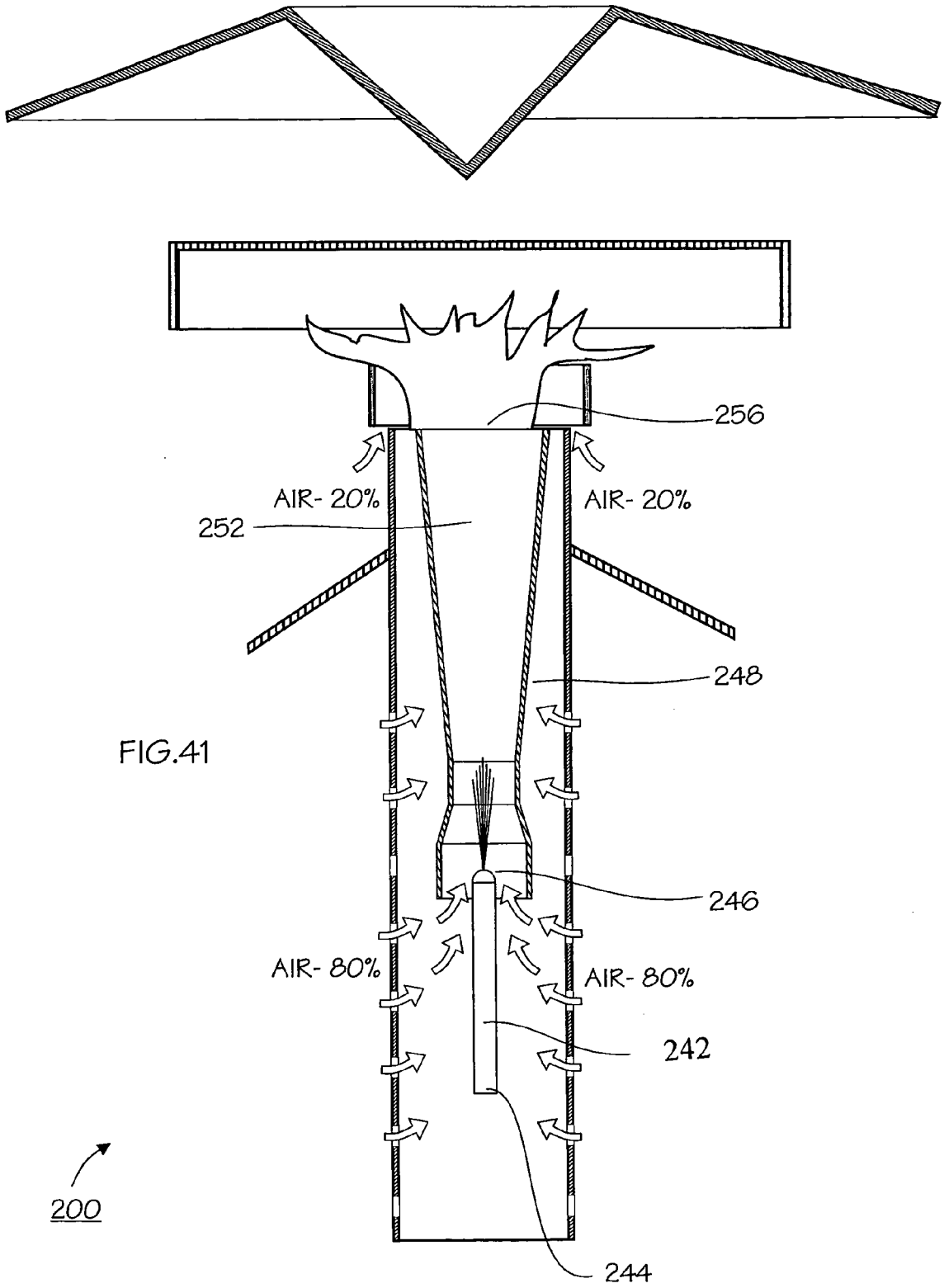
FIG. 41 is a partial schematic cross sectional view of the burner components of the radiant heater 200 as depicted in FIG. 17.
Figure 42:
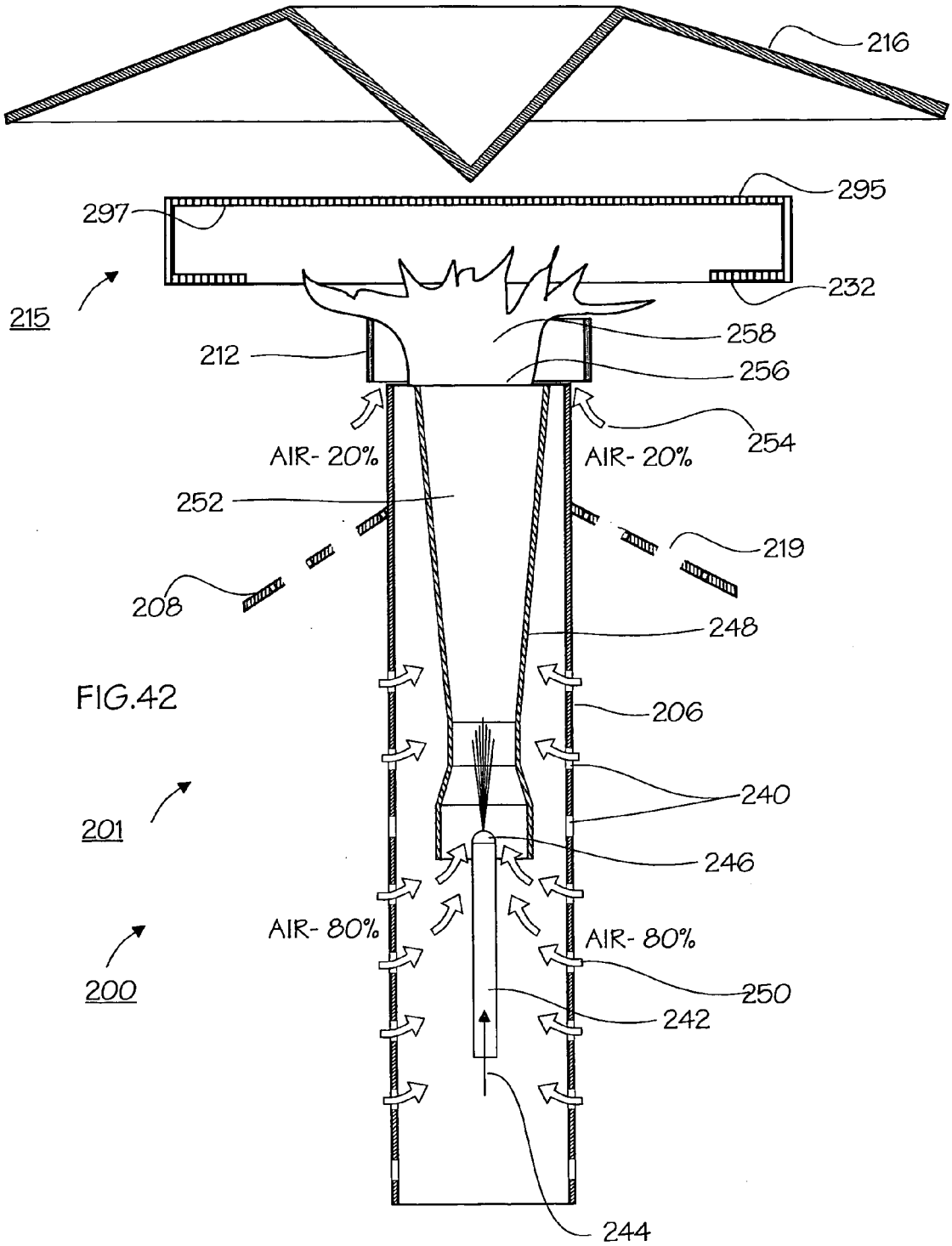
FIG. 42 is a partial schematic cross sectional view of the burner components of the radiant heater 200 as depicted in FIG. 17 with a emitter having a bottom flange and the deflector shown with holes.
Figure 43:
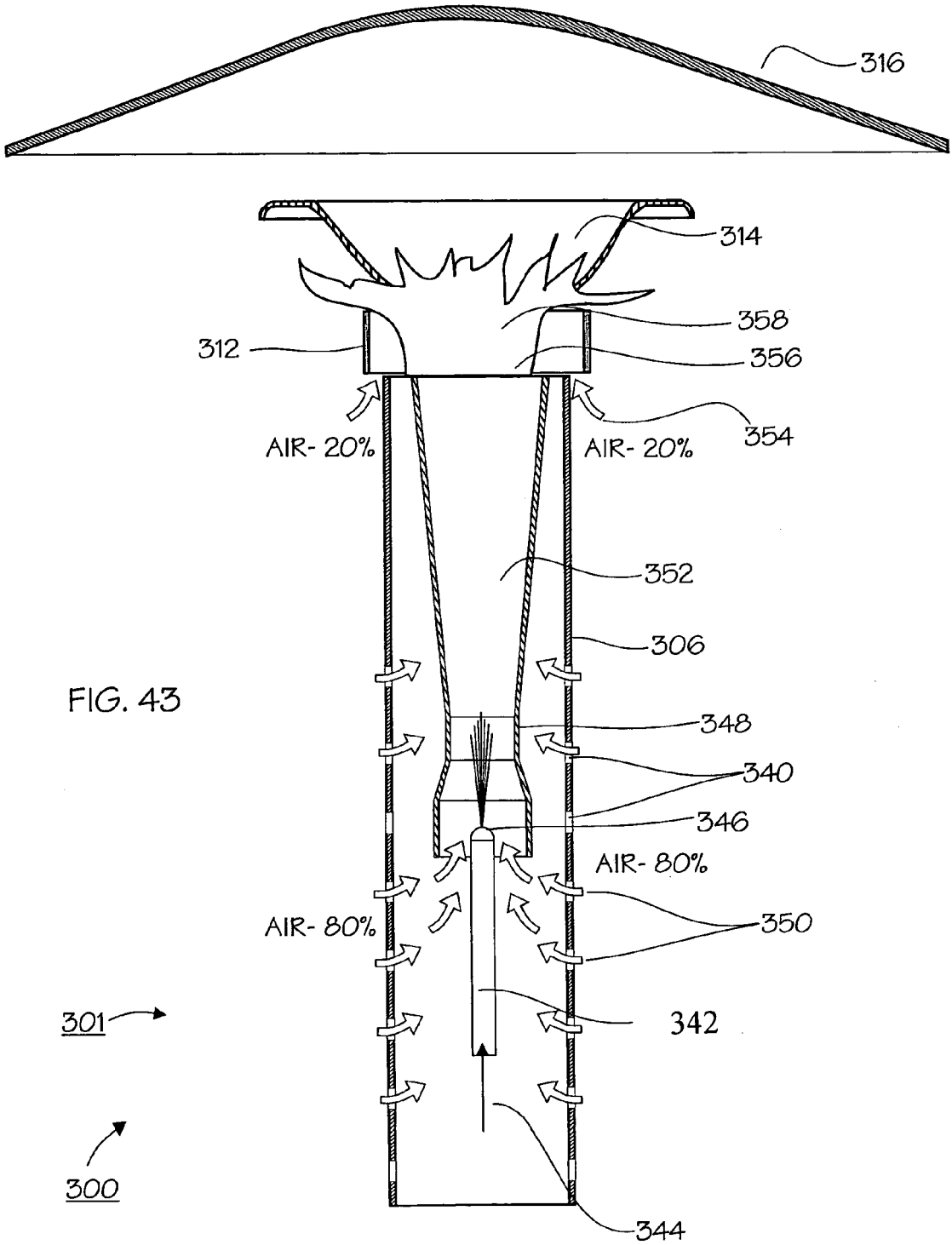
FIG. 43 is a partial schematic cross sectional view of the burner components of the radiant heater 300 as depicted in FIG. 21.

By way of example only the presently invented burner 101 will now be described with reference to FIG. 40, however burners 201, 203 and 301 operate in analogous fashion is also depicted in FIGS. 41, 42 and 43. The present invention burner 101 mixes gas 144 with approximately 80% primary combustion air 150. Unlike the prior art devices which use anywhere from 10 to 30% primary combustion air, the present invention uses anywhere from 70 to 90% primary combustion air 150, wherein primary combustion air 150 and gas 144 which exists from gas orifice 146, passes through venturi 148 and is thoroughly mixed together in mixing chamber 152 and is ignited at flame retainer 156. The resulting flame 158 has a much higher flame velocity as prior art flame 914 and in contrast to flame 914, flame 158 is a stable higher velocity flame which is less susceptible to being disturbed by ambient wind conditions. Additional secondary combustion air 154 is introduced just above flame retainer 156 to provide for complete combustion of gas 144 within flame 158. With this geometry one can very carefully position emitter 114 into the hottest portion of flame 158, thereby maximizing the emitter 114 temperature.

As depicted in FIGS. 40, 41, 42 and 43, different emitter shapes are possible and a person skilled in the art will see that the shape of the deflector 116 is matched to the shape of emitter 114 and in similar fashion the shape of the deflector 216 is matched to the emitter 214 and the shape of the deflector 316 is matched to the emitter 314.

The advantage of the presently invented burners 101, 201 and 301 is that the emitter 114, 214, 215 and 314 can be placed in the hottest portion of the flame. Additionally, flame 158 being a higher velocity stable flame is not as susceptible to being disturbed by wind or other ambient conditions and therefore the temperature of emitter 114, is more stable and uniform.

Furthermore, optionally a flame jacket 112 which is preferably made of a clear glass is used to further funnel and direct flame 158 onto emitter 114 and aid in, drawing in additional secondary combustion air 154 thereby providing for even greater flame stability and flame velocity.

Referring to FIG. 18 for example, emitter 214 which is essentially a horizontally flat circular emitter having an outer flange 228 and optionally an additional bottom flange 222, one can see that the direct emissions 220 emitting from emitter 214 reflected by deflector 216 as well as deflector 208 are redirected in a controlled manner onto a surface 16. Radiant emissions from emitter 214 reflect off of deflector 216 as well as deflector 208 in such a manner to maximize the amount of reflected emissions 222 which reach surface 16. In addition emitter 214 radiates direct emissions 220 substantially entirely or predominately vertical upwards toward deflector 216 or 208 or vertically downwards toward surface 16. This assures that substantially all of direct emissions 220 directly or indirectly reach surface 16. In contrast many of the direct emissions of prior art radiant heater 900 never reach surface 16 such as stray emissions 921 shown in FIG. 8.

In addition the shape of deflector 216 and deflector 208 is optimized in order to provide for a more uniform effective radiant flux distribution as shown in two dimensions in FIG. 12 and three dimensionally as shown in FIG. 7. Through trial and error and also through scientific measurement, one can optimize or match the shape of the deflector 116 to the emitter 114 to provide for an optimum collective radiant flux distribution typically as shown by FIG. 12 for the presently invented radiant heaters, 100, 200 and 300.

Furthermore, a person skilled in the art will note that effective or useful radiant emissions are obtained from both sides of emitter 214, namely both the top surface 295 which sends direct emissions vertically upwardly onto deflector 216 as well as bottom surface 297 which sends direct emissions vertically downwardly onto deflector 208, but also direct emissions 220 may travel straight through any holes in deflector 208 or past deflector 208. Therefore, the effective radiant flux seen by surface 16 for the presently invented radiant heaters can be a combination of direct emissions 220 as well as reflected emissions 222 and the reflected emissions 222 can be controlled or directed through matching of the deflector 216, the deflector 208 with the shape of the emitter 214.

Referring to FIG. 22 for example having an emitter 314, one can see that a large amount of the radiant emissions from emitter 314 are felt as direct emissions 320 as well as reflected emissions 322. In this manner, both top and bottom emitter surfaces can be utilized, thereby minimizing the size of the emitter.

Heat exchange between the flame and the emitter is promoted by gases passing through the perforations and therefore, the temperature of the emitter increases in those areas where the number and density of perforations is the greatest. In this manner by selectively placing perforations in the emitter on can maximize temperature uniformity across the entire emitter surface.

It should be apparent to persons skilled in the arts that various modifications and adaptation of this structure described above are possible without departure from the spirit of the invention the scope of which defined in the appended claim.

We claim:

1. A radiant heat deflector assembly for radiating heat on a surface, said assembly comprising:

(a) a radiant heat source radiating direct emissions; and (b) at least one radiant heat deflector spaced from the heat source; and (c) wherein said heat source is so positioned and configured to include radiating direct emissions onto said deflector, said deflector being so positioned, configured and sized as to reflect radiant emissions onto a surface thereby heating the surface;

(d) characterized in that said heat source includes an emitter for producing the radiant emissions as direct radiant emissions, the emitter adapted to produce useful emissions from a top surface and a bottom surface of the emitter, the heat source further including vertically underneath said bottom surface, a burner for producing a flame for heating the emitter located above the flame, and (e) wherein the top surface is one side of the emitter and the bottom surface is the other side of the emitter such that the top surface is oriented to radiate useful emissions towards the deflector and the bottom surface is oriented to radiate useful emissions directly toward the surface to be heated.

2. The radiant heat deflector assembly claimed in claim 1, wherein said heat source is adapted to radiate useful direct emissions upwardly from the top surface towards said deflector and downwardly from the bottom surface toward the surface or onto a second deflector such that both direct emissions and reflected emission heat said surface.

3. The radiant heat deflector assembly claimed in claim 1 wherein emissions from the top surface are reflected by the deflector to reach the surface.

4. The radiant heat deflector assembly claimed in claim 3, wherein a second deflector is located below the emitter.

5. The radiant heat deflector assembly claimed in claim 1 wherein said emitter includes a number of perforations, wherein said perforations are distributed to optimize the temperature uniformity of the emitter.

6. The radiant heat deflector assembly claimed in claim 5, wherein the number and density of perforations is greater in the naturally coldest area of the emitter.

7. The radiant heat deflector assembly claimed in claim 1 in which the emitter includes an inverted conical section.

8. The radiant heat deflector assembly claimed in claim 7, wherein said inverted conical section is more steeply sloped proximate an outer rim of said emitter.

9. The radiant heat deflector assembly claimed in claim 1, with said deflector positioned above said emitter, and said deflector including in a central circular flat section, and attached to the outer periphery of the central flat section in cross section, an outer downwardly sloped section.

10. The radiant deflector assembly claimed in claim 1 wherein, said emitter including a flat circular section.

11. The radiant heat deflector assembly claimed in claim 10, wherein said emitter including a cylindrically shaped outer flange extending vertically downwardly from the outer periphery of said flat circular section.

12. The radiant heat deflector assembly claimed in claim 11, wherein said emitter including a ring shaped bottom flange extending horizontally inwardly from a distal periphery of said cylindrical outer flange.

13. The radiant heat deflector assembly claimed in claim 1, wherein said emitter including an upstanding bowl-shaped conical section.

14. The radiant deflector assembly claimed in claim 13, wherein said upstanding bowl-shaped conical section terminating in a down-turned outer rim.

15. The radiant heat deflector assembly claimed in claim 1, wherein said heat source including a burner producing a flame for heating said emitter, said burner including a gas nozzle disposed within a venturi for drawing in primary combustion air and gas.

16. The radiant heat deflector assembly claimed in claim 15, wherein said venturi further including a mixing chamber for thoroughly mixing the primary combustion air and the gas.

17. The radiant heat deflector assembly claimed in claim 16, wherein the primary combustion air provides at least 70% of the total amount of combustion air required for complete combustion of the gas.

18. The radiant heat deflector assembly claimed in claim 17, wherein the venturi being cylindrical in shape and shrouded by an externally disposed cylindrically shaped air inlet cover.

19. The radiant heat deflector assembly claimed in claim 17, wherein said venturi further including a flame retainer proximate the upper end of the said venturi.

20. The radiant heat deflector assembly claimed in claim 17, wherein said burner further including a flame jacket for funneling the flame from said burner and protecting said flame from ambient winds.

21. The radiant heat deflector assembly claimed in claim 1, wherein said heat source is adapted to radiate useful direct emissions from the top surface of the emitter upwardly towards said deflector and to radiate useful direct emissions from a bottom surface of the emitter downwardly toward the surface or onto a second deflector such that both emissions from the top surface and bottom surface of the emitter are directed to heat said surface.

22. The radiant heat deflector assembly as claimed in claim 1, wherein substantially all of the emissions from the top surface of the emitter are useful emissions.

23. The radiant heat deflector assembly as claimed in claim 1, wherein substantially all of the emissions from the top surface of the emitter are useful emissions, and wherein substantially all of the emissions from the bottom surface are useful emissions.

* * * * *